US012169106B2

(12) United States Patent
Boretto et al.

(10) Patent No.: US 12,169,106 B2
(45) Date of Patent: Dec. 17, 2024

(54) HYBRID CARBON-STEEL FIREARM BARREL

(71) Applicant: BLACKPOWDER PRODUCTS, INC., Lawrenceville, GA (US)

(72) Inventors: Tod D. Boretto, Poway, CA (US); Daniel J. Hanus, Buford, GA (US); Brady E. Sandercock, Duluth, GA (US); Ion Racionero, Arrasate (ES)

(73) Assignee: Blackpowder Products, Inc., Lawrenceville, GA (US)

( * ) Notice: Subject to any disclaimer, the term of this patent is extended or adjusted under 35 U.S.C. 154(b) by 0 days.

(21) Appl. No.: 18/355,711

(22) Filed: Jul. 20, 2023

(65) Prior Publication Data

US 2024/0133649 A1 Apr. 25, 2024
US 2024/0230264 A9 Jul. 11, 2024

Related U.S. Application Data

(63) Continuation of application No. 17/845,167, filed on Jun. 21, 2022, now Pat. No. 11,732,988, which is a continuation of application No. 17/666,830, filed on Feb. 8, 2022, now Pat. No. 11,385,013, and a continuation-in-part of application No. 17/165,721, filed on Feb. 2, 2021, which is a continuation-in-part of application No. 15/639,654, filed on Jun. 30, 2017, now Pat. No. 10,907,942.

(60) Provisional application No. 63/305,797, filed on Feb. 2, 2022, provisional application No. 63/215,753, filed on Jun. 28, 2021, provisional application No. 63/150,212, filed on Feb. 17, 2021, provisional application No. 63/086,017, filed on Sep. 30, 2020, (Continued)

(51) Int. Cl.
*F41A 21/04* (2006.01)

(52) U.S. Cl.
CPC ..... *F41A 21/04* (2013.01)

(58) Field of Classification Search
CPC ..... F41A 21/04
USPC ..... 42/76.02
See application file for complete search history.

(56) References Cited

U.S. PATENT DOCUMENTS 4,424,734 A 1/1984 Janssen et al.
4,485,721 A 12/1984 Shankhla et al.
(Continued)

FOREIGN PATENT DOCUMENTS

CH 682843 A5 11/1993
CN 203798247 U 8/2014
(Continued)

OTHER PUBLICATIONS https://www.bsfbarrels.com; Carbon Fiber Barrels—USA—BSF Barrels; Jun. 2, 2021; 3 pgs.

*Primary Examiner* — Samir Abdosh
(74) *Attorney, Agent, or Firm* — Perilla Knox & Hildebrandt LLP

(57) ABSTRACT

A hybrid metal and composite barrel assembly for a firearm preferably includes a metal inner barrel liner and a composite outer barrel sleeve. The composite outer barrel sleeve preferably includes at least one layer of woven metal mesh material comprising a plurality of metallic fibers, and at least one layer of carbon fiber material comprising a plurality of carbon fibers. The composite outer barrel sleeve is preferably engaged around the metal inner barrel liner, and optionally incorporates a tensioning nut to retain the sleeve on the liner.

23 Claims, 20 Drawing Sheets

Related U.S. Application Data provisional application No. 62/374,508, filed on Aug. 12, 2016, provisional application No. 62/357,778, filed on Jul. 1, 2016.

(56) References Cited

U.S. PATENT DOCUMENTS

| | | | | |
|---|---|---|---|---|
| 4,646,615 | A | 3/1987 | Gladstone et al. | |
| 4,685,236 | A | 8/1987 | May | |
| 4,729,806 | A | 3/1988 | Stein | |
| 5,315,914 | A | 5/1994 | Schumacher | |
| 5,348,598 | A | 9/1994 | Vives et al. | |
| 5,546,844 | A | 8/1996 | Krumm et al. | |
| 5,600,912 | A | 2/1997 | Smith | |
| 5,657,568 | A | 8/1997 | Christensen | |
| 5,804,756 | A | 9/1998 | Christensen et al. | |
| 6,189,431 | B1 | 2/2001 | Danner et al. | |
| 6,230,429 | B1 | 5/2001 | Smith | |
| 6,457,274 | B2 | 10/2002 | Smith | |
| 6,482,248 | B1 | 11/2002 | Holloway et al. | |
| 6,758,004 | B2 | 7/2004 | Huston | |
| 6,889,464 | B2 * | 5/2005 | Degerness | F41A 21/02 42/76.01 |
| 7,152,357 | B2 | 12/2006 | Huston | |
| 7,412,956 | B2 | 8/2008 | Gotou et al. | |
| 7,721,478 | B2 | 5/2010 | Withers et al. | |
| 7,802,393 | B2 | 9/2010 | Judson et al. | |
| 7,866,079 | B2 | 1/2011 | Keeney et al. | |
| 8,020,333 | B2 | 9/2011 | Hall et al. | |
| 8,112,930 | B2 | 2/2012 | Sietsema | |
| 8,261,480 | B2 | 9/2012 | Hall et al. | |
| 8,615,916 | B2 | 12/2013 | Bassoli et al. | |
| 8,776,425 | B2 | 7/2014 | Pelin | |
| 8,863,429 | B2 | 10/2014 | Pelin | |
| 9,677,845 | B2 | 6/2017 | Cook, Jr. et al. | |
| 9,863,732 | B2 * | 1/2018 | Curliss | F41F 1/06 |
| 10,001,337 | B2 * | 6/2018 | Curliss | F41A 21/20 |
| 10,113,824 | B2 | 10/2018 | Kowalski et al. | |
| 10,168,117 | B2 | 1/2019 | Curliss et al. | |
| 10,228,209 | B2 | 3/2019 | Newman | |
| 10,345,068 | B2 | 7/2019 | Tyler et al. | |
| 10,365,061 | B1 * | 7/2019 | Painter | F41A 5/26 |
| 10,718,586 | B2 | 7/2020 | Glisovic et al. | |
| D900,948 | S * | 11/2020 | Curliss | D22/108 |
| 10,907,921 | B1 * | 2/2021 | Painter | F41A 5/26 |
| 10,907,942 | B2 * | 2/2021 | Greenwood | F42B 6/04 |
| 11,079,194 | B1 * | 8/2021 | Sinnema | F41A 21/02 |
| 11,131,518 | B2 | 9/2021 | Teetzel et al. | |
| 11,421,971 | B2 | 8/2022 | Vabnick | |
| 2005/0108916 | A1 | 5/2005 | Keeney et al. | |
| 2007/0256345 | A1 | 11/2007 | Hall et al. | |
| 2008/0251060 | A1 | 10/2008 | Thurber | |
| 2010/0051004 | A1 | 3/2010 | Lian | |
| 2015/0040454 | A1 | 2/2015 | Naik et al. | |
| 2016/0209143 | A1 * | 7/2016 | Curliss | F41A 21/04 |
| 2016/0334180 | A1 * | 11/2016 | Curliss | F41A 21/02 |
| 2016/0363402 | A1 * | 12/2016 | Mogle | F41A 21/02 |
| 2017/0205172 | A1 * | 7/2017 | Curliss | F41A 21/16 |
| 2017/0261280 | A1 * | 9/2017 | Glisovic | F41A 21/24 |
| 2017/0284758 | A9 | 10/2017 | Glisovic et al. | |
| 2018/0017350 | A1 * | 1/2018 | Kowalski | B32B 5/26 |
| 2018/0023913 | A1 * | 1/2018 | Newman | F41A 21/04 42/76.1 |
| 2019/0226786 | A1 | 7/2019 | Sloan | |
| 2021/0252352 | A1 * | 8/2021 | Greenwood | B29C 70/885 |
| 2021/0389107 | A1 * | 12/2021 | Vabnick | F41A 21/02 |
| 2022/0018622 | A1 * | 1/2022 | Massarello | F41A 21/04 |

FOREIGN PATENT DOCUMENTS

| | | | | |
|---|---|---|---|---|
| CN | 106705748 | B | 6/2018 | |
| FR | 2580065 | B1 | 3/1989 | |
| JP | H06101993 | B2 | 12/1994 | |
| JP | 6101993 | B2 | 3/2017 | |
| RU | 2557892 | C2 | 7/2015 | |
| WO | 2001002789 | A2 | 1/2001 | |
| WO | WO-2015031635 | A1 * | 3/2015 | B29C 70/342 |
| WO | WO-2015130379 | A2 * | 9/2015 | B32B 15/14 |
| WO | 2016160308 | A1 | 10/2016 | |

* cited by examiner

47

| RECORD FOR ALL ROUNDS TESTED | | | | RECORD ONLY IF ACCURACY TESTING | | | | | |
|---|---|---|---|---|---|---|---|---|---|
| ITEM # 48 | RECEIVER TO STOCK TORQUE VALUE | MAG OR BDL | AMMO | TORQUE FT LBS | GROUP SIZE | GROUP SIZE | AVG GROUP | DISTANCE 49 | NOTES 50 |
| B14 - 6.5 CREEDMOR | 55 | MAG OR BDL | 6.5, HDY 147gr GM | 0 | 0.935 | 1.295 | 1.115 | 100 YDS | 100% STEEL BARREL BEFORE TUBE BONDED |
| | 55 | | | 5 | 0.591 | 0.644 | 0.618 | 100 YDS | |
| 51 | 55 | | | 10 | 0.556 | 0.618 | 0.587 | 100 YDS | |
| | 55 | | | 15 | 0.549 | 0.722 | 0.636 | 100 YDS | |
| B14 - .308 CALIBER | 55 | MAG | 308 FED 168gr GM | 0 | 1.461 | 1.952 | 1.138 | 100 YDS | 100% STEEL BARREL BEFORE TUBE BONDED |
| | 55 | | | 5 | 0.751 | 0.581 | 0.666 | 100 YDS | 53 |
| 52 | 55 | | | 10 | 1.061 | 0.605 | 0.833 | 100 YDS | |
| | 55 | | | 15 | 0.578 | 0.798 | 0.688 | 100 YDS | |
| B14 - .300 WIN MAG | 55 | MAG OR BDL | 300WM, BERG 185gr | 0 | 0.582 | 0.683 | 0.633 | 100 YDS | 100% STEEL BARREL BEFORE TUBE BONDED |
| | 55 | | | 5 | 0.510 | 0.623 | 0.567 | 100 YDS | |
| | 55 | | | 10 | 0.340 | 0.589 | 0.465 | 100 YDS | |
| | 55 | | | 15 | 0.359 | 0.584 | 0.472 | 100 YDS | |

FIG. 18

HYBRID CARBON-STEEL FIREARM BARREL

CROSS-REFERENCE TO RELATED APPLICATIONS

This application is a continuation of U.S. Non-Provisional patent application Ser. No. 17/845,167 filed Jun. 21, 2022, which is a continuation of U.S. Non-Provisional patent application Ser. No. 17/666,830 filed Feb. 8, 2022, now U.S. Pat. No. 11,385,013 filed Jul. 12, 2022, which claims the priority benefit of U.S. Provisional Patent App. Ser. No. 63/305,797 filed Feb. 2, 2022, U.S. Provisional Patent App. Ser. No. 63/215,753 filed Jun. 28, 2021, and U.S. Provisional Patent App. Ser. No. 63/150,212 filed Feb. 17, 2021; and this application is a continuation-in-part of U.S. patent application Ser. No. 17/165,721 filed Feb. 2, 2021, which claims priority to U.S. Provisional Patent App. Ser. No. 63/086,017 filed Sep. 30, 2020, and is a continuation-in-part of U.S. patent application Ser. No. 15/639,654 filed Jun. 30, 2017, now U.S. Pat. No. 10,907,942 issued Feb. 2, 2021, which claims priority to U.S. Provisional Patent App. Ser. No. 62/374,508 filed Aug. 12, 2016 and to U.S. Provisional Patent App. Ser. No. 62/357,778 filed Jul. 1, 2016, the entireties of which are incorporated by reference herein.

TECHNICAL FIELD

The present invention relates generally to the field of barrels for firearms, and more particularly to a composite carbon and steel barrel for firearms, and methods of manufacture thereof.

BACKGROUND

Carbon composite rifle barrels have been in existence for over 30 years beginning with small caliber rifle rounds and migrating up to today's larger caliber more powerful rifle rounds. This migration has taken a relatively long period of time due to the heat limitations of most advanced composite materials. The heat generated during the firing event creates temperatures that can soften and significantly weaken a composite structure. Steel barrels are generally far less susceptible to the same heat generated, however steel typically weighs 4 times as much as carbon/epoxy.

Over the years, there have been many efforts to address the heat management of the barrel. For example, U.S. Pat. No. 9,863,732 refers to a Mortar Round Launch Tube. The primary method of thermal management created by the explosion of the charge, is to infuse the polymer resin matrix with highly conductive metallic particles. These particles are mixed into the polymer resin at a very high percentage compared to the other components in the polymer resin matrix. This technique may raise the thermal conductivity of said polymer resin, however it also weakens the overall polymer strength and therefore the overall composite structure strength. Loading the polymer resin with these metallic particles at high loading rates, would likely lower virtually all of the mechanical properties of the composite structure. This includes flexural strength, tensile strength, compressive strength along with a significant reduction in the fatigue properties of the composite structure. Since the metallic particles are not part of the polymer resin chain, they likely only reduce the overall strength of the chain and at the same time are also likely to create initiators for micro crack propagation within the composite structure.

Another reference that relies on filling the polymer resin with conductive metallic fillers is U.S. Pat. No. 6,889,464. This patent also generally relates to a filament wound composite structure that utilizes highly loaded polymer resin matrices. These matrices consist of metallic particles mixed into the base polymer resin so that the thermal conductivity values equal that of the steel barrel/liner. For the thermal conductivity to be uniform both through the thickness of the composite structure and down the length of the composite structure, the metallic particles typically must make physical contact with each other for the thermal transfer to be efficient and uniform. If the particles do not touch each other, it acts as a break in the chain which lowers the thermal conductivity and the rate at which the heat is conducted. Furthermore, the composite structure is a mixture of a fiber reinforcement and the resin. The typical fiber to resin ratio in most fiber reinforced composites is 60% fiber to 40% resin based upon volume. Therefore, to achieve a high thermal conductivity in the composite structure, the percentage loading rate of the metallic particles compared to the polymeric resin is typically maximized to the point of saturation. Both design approaches fail to mention the detrimental effects that the metallic particles cause in the composite structures. In both of these examples, it appears that the primary focus was on trying to match the thermal conductivity of the sub surface barrel or liner.

The Curliss Patent (U.S. Pat. No. 9,863,732) discloses that the thermal conductivity of said composite structure exceeds a minimum of 75 watts per meter per degree Kelvin which is close to the thermal conductivity of the sub surface metal barrel.

Both U.S. Pat. Nos. 9,863,732 and 6,889,464 disclose that the method of manufacturing the composite barrels rely on a filament winding process whereby individual carbon fiber tows are helically wound around the steel Barrel liner or steel mandrel. This process is the preferred manufacturing process for making fast tapering composite tubes like softball bats, tapered rifle barrels, pressure vessels, etc. It is an automated process that allows one to build a tubular composite structure with a low labor content and is ideally suited for making composite pressure vessels due to the fact that one can wind the carbon fibers in a continuous fashion. Because the fibers are continuous in a pressure vessel, this increases the burst pressure strength significantly over pressure vessels manufactured out of a metallic substrate. In the case of rifle barrels, filament winding fibers that are transverse to the axial (longitudinal) direction, provide significant hoop strength thusly increasing the burst pressure strength associated with the explosive forces created when a rifle cartridge is ignited. Another advantage of filament winding is that it allows for easy fiber angle changes during the manufacturing process.

In the case of a carbon fiber rifle barrel that is manufactured via the filament winding process, there is at least one major inherent weakness that this process creates. This weakness is the fact that this process is limited to applying the axial (longitudinal) carbon fibers at a fiber angle that at best is 5 to 8 degrees off-axis from the true longitudinal (bore) axis. This off-axis fiber alignment effects the barrel stiffness and longitudinal compressive strength of the composite barrel in a negative way. Within the laminate structure, these off-axis plies create a large amount of residual stress in the laminate that can cause the barrel to twist and bend when the Barrel starts to heat up due to firing. This has a negative effect on barrel accuracy, barrel stiffness and vibration damping during firing. To compensate for some of the negative impacts due to using this manufacturing process, a typical approach is to overbuild the composite barrel by adding substantially more material to basically try to overpower the natural tendency of the barrel movement as the barrel starts to heat up. This results in a heavier barrel than would otherwise be necessary.

Accordingly, it can be seen that needs exist for improved composite firearm barrels and methods of manufacture thereof. It is to the provision of improved barrels and manufacturing methods meeting these and other needs that the present invention is primarily directed.

SUMMARY

The present invention relates generally to improved composite firearm barrels and methods of manufacture thereof. In example embodiments, the invention provides a composite rifle barrel that reduces the steel barrel equivalent weight significantly, for example by about 50%, while maintaining or increasing the barrel accuracy during a cold to hot temperature transition regime.

Various embodiments of the present invention provide for a lightweight hybrid composite/steel barrel construction for bolt action target and hunting rifles, and/or for various other types of firearms. The present invention can be summarized into the following general areas:

- Non-Metallic composite materials
- Metallic composite materials
- Example methods of manufacturing of composite rifle barrel component
- Example methods of manufacturing hybrid composite/steel barrel assembly In example forms, the non-metallic portion of the composite barrel tube consists of, comprises or includes a plurality of layers of various types of carbon fiber and carbon fabric prepreg that are stacked in numerous layers and at a variety of fiber angles to achieve the desired balance of longitudinal barrel stiffness and sufficient hoop strength to overcome the stresses associated with the ignition of the explosive cartridge. In an example embodiment, the carbon fiber utilized is categorized as PAN (polyacrylonitrile, $(C_3H_3N)_n$) based carbon fiber with a variety of different grades of carbon fiber. PAN based carbon fibers can range in fiber modulus (Youngs Modulus) from 33 Msi (million pounds per square inch) up to 70 Msi. These fibers are then combined with a polymeric resin that in example embodiments of this invention may be a damage tolerant epoxy resin. These two materials are combined to form a material termed unidirectional prepreg. The prepreg material is a continuous roll made up of numerous strands of the individual carbon fiber tows. Unlike filament winding whereby the operator applies a single tow in a continuous wrapping fashion, the prepregs utilized in this invention are made into wide continuous rolls whereby the concentric layers are cut out to form the general shape of the barrel profile. Once these patterns are cut from the main prepreg roll, they are then rolled around a steel mandrel, compressed via a means of applying compaction force, and then heat cured in an oven or hot press to form a rigid hollow barrel tube.

Rather than relying on adding metallic particles or chopped pitch fibers to the resin to achieve high levels of thermal conductivity, the epoxy resin utilized in some example embodiments of the present invention has no metallic fillers added. Furthermore, the epoxy resin may be a standard 285 F curing epoxy resin with a glass transition (Tg) temperature of, for example, about 225° F. In the patents discussed in the Background section above, the resins associated with these patents are typically considered "High Temperature" resins because the addition of the metallic particles is actually puffing more heat from the steel barrel liner into the composite structure raising the temperature of the resin which generally requires resins that have a high glass transition (Tg) temperature.

Although the PAN based carbon fibers are the primary disclosed type of carbon fiber in this invention, it is also contemplated that pitch-based carbon fiber, and other types of fiber reinforcements such as fiberglass, aramid, and/or PBO (polybenzoxazole) can also be utilized. This can also be said about the types of polymeric resins that can be utilized in this invention. Although the primary embodiment disclosed utilizes an unfilled epoxy resin, other types of resins can be used such as cyanate ester, polyimide, phenolic, thermoplastic resin, etc.

As mentioned earlier, when metallic particles are added to the resin to increase the overall thermal conductivity of the composite barrel, it typically weakens the composite structure and provides no additional stiffness to the barrel itself. The metallic particles simply increase the overall density of the resin in addition to raising the thermal conductivity of the resin. The other problem that these metallic particles present, is that by having the metallic particles dispersed throughout the entire composite structure, the entire structure then heats up to the same level of the steel barrel instead of acting as an insulator. This causes issues with the resin softening and thusly reduces the barrel stiffness which has a direct effect of rifle accuracy.

The metallic composite portion utilized in example embodiments of the present invention addresses this issue by incorporating a unique metallic mesh comprised of continuous metallic filaments that extend in a continuous fashion from the breech end to the muzzle end of the composite barrel. This unique mesh consists of steel filaments that are woven to form a fabric weave, which is then impregnated with the same epoxy resin contained in the carbon fiber reinforced section of the same barrel tube. This metallic woven prepreg is then cut into circumferentially concentric patterns that run continuously down the longitudinal axis of the barrel. The number of layers of this weave can vary depending on the amount of heat generated during the single firing event or through repeated firings events over a period of time commonly referred to as the "cyclic rate". In the case of bolt action rifles, the amount of heat generated compared to a semi-automatic rifle or even fully automatic rifle is typically far less due to the cyclic rate differences.

In a representative example embodiment, this metallic weave is comprised of a 304 stainless steel wire with a wire diameter of between about 0.001" to 0.010". In alternate embodiments, other types of steel or other metals and/or other wire diameters may be utilized. Although the thermal conductivity of stainless steel is not as high as other metals like aluminum and copper, stainless steel provides many other benefits that outweigh its lower thermal conductivity compared to these highly thermally conductive metals. As can be seen in Table 1, the comparative thermal conductivities of various metals like stainless steel are well below that of copper and aluminum.

TABLE 1

| Material | Thermal conductivity [W/mk] |
|---|---|
| Silver | 428 |
| Copper (pure) | 399 |

TABLE 1-continued

| Material | Thermal conductivity [W/mk] |
|---|---|
| Gold (pure) | 317 |
| Aluminum (pure) | 237 |
| Iron (pure) | 80.2 |
| Carbon Steel (1%) | 43 |
| Stainless steel | 15.1 |
| Carbon fiber | 1 |
| Glass | 0.81 |
| Water | 0.6 |
| Plastics | 0.2-0.3 |
| Wood | 0.087 |
| Air | 0.026 |

However, stainless steel is still 15 times more (see table 1) thermally conductive than the surrounding carbon fiber/epoxy layers. Furthermore, stainless-steel has a much higher modulus of elasticity compared to aluminum and copper, which significantly contributes to increasing the overall barrel stiffness. Both copper and aluminum are very malleable metals which are much "softer" than stainless steel and are prone to bending at much lower stress levels. Another factor to take into account when choosing the metal for the metallic weave is the potential for galvanic corrosion associated with combining certain metals like aluminum with carbon fiber in a structure. This can cause corrosion and structural deterioration of the composite leading to a catastrophic failure.

Another important factor associated with this novel metallic weave, is the weave style itself. Woven fabrics have a plethora of weave styles associated with them ranging from basket weaves, plain weaves, multi harness satin weaves, braids, Dutch weaves, etc. As used herein with reference to woven materials, the longitudinal axis (Rifle Bore axis) is called the "warp" direction and the transverse direction (90 degrees from axial direction) is called the "weft" direction. Example embodiments of the present invention include a ratio of the warp direction fibers compared to the weft direction fibers of approximately 70% warp and 30% weft. This ratio may vary depending on the cyclic rate and overall heat generated due to the weapon style and caliber of round, for example within a range of about 60% to 80% warp fibers and a corresponding range of about 40% to 20% weft fibers, respectively.

In particular example embodiments of the present invention, the composite pattern layers are wrapped around a steel mandrel that matches the taper rate and outer dimensions of the machined down steel barrel. The mandrel is designed to allow for a minimum adhesive bondline thickness of, for example, about 0.005" throughout the entire longitudinal axis of the composite barrel tube. In example embodiments, all or substantially all of the individual plies throughout the wall thickness of the barrel tube, consist of single plies that are circumferentially concentric. The first concentric composite layers that are wrapped around the steel mandrel are comprised of this novel stainless-steel weave that is highly directional. The longitudinal direction of the stainless-steel wires is oriented in the axial (bore direction) of the barrel itself. In essence, the metallic mesh runs the entire length of the barrel where the barrel is reinforced with composite material. In example embodiments, this core of stainless-steel and composite provides both increased structural strength and a thermally conductive core in this area that is 15 times greater than the carbon fiber/epoxy alone. Therefore, when the heat is generated from the firing event, it conducts through the steel barrel into the metallic weave strands contained in the first layers of the composite. This allows the heat to move along the bore axis much faster than through the thickness of the remaining composite located outboard of the metallic weave core.

In the case of high caliber rounds such as .300, .308, 6.5 mm, etc., particular example embodiments of the present invention contain at least one, and optionally a plurality of, for example, two, three, four or more discrete layers of 0.0024" thick stainless-steel weave or mesh prepreg with each layer comprising an interleaf layer of carbon fiber prepreg oriented in the hoop direction of the barrel. In example embodiments, the thickness of the carbon fiber prepreg is the same as the stainless steel prepreg or approximately 0.0024. Each consecutive layer of the combined stainless steel prepreg is attached to the carbon fiber prepreg interleaf. Then the ply of the combined materials is rolled in a counter-clockwise direction as it is being attached. In example embodiments incorporating four layers of the attached plies, they are clocked or offset from one another at 90-degree increments as are the subsequent layers of the carbon fiber prepregs. This clocking of the composite layers extends throughout the structure up through the outer surface of the barrel tube. This maintains uniform wall thickness and reduces variations in the transfer of heat due to having a uniform wall thickness. The carbon fiber interleaf layer attached to the stainless-steel weave provides significant hoop strength to counter the hoop stresses associated with the explosion of the cartridge. This is due to the 90-degree orientation of the carbon fiber. In alternate embodiments, fewer or more layers and/or different thicknesses may be utilized.

Another added benefit of the carbon fiber interleaf is that it acts as an insulation layer between the adjacent plies of the stainless-steel weave layers, due to the fact that the through thickness coefficient of thermal expansion along with the coefficient of thermal conductivity through the thickness is very low. This is due to the fact that the through thickness properties are a resin dominant property. If we were to add metallic particles into the polymer resin as has been done in the aforementioned background reference examples, then the thermal conductivity of the resin would increase substantially, and the interleaf would no longer act as an insulator. Because conductivity is the inverse of resistivity, as you increase the conductivity of the resin in the entire structure you increase the overall temperature of the resin which creates a softening in the resin as the heat approaches the glass transition (Tg) temperature. This then equates to a softening in the stiffness of the barrel which in turn effects the accuracy of the barrel and the weapon.

Since the carbon interleaf is providing an insulation barrier between each one of the four stainless steel plies in example embodiments of the present invention, the stainless-steel filaments that are oriented in the axial (bore) direction provide for a highly conductive thermal pathway that exits it at the muzzle. If all of the stainless-steel plies were allowed to make contact with each other, then the entire thickness of the stainless-steel section would increase and hold temperature more than if they are separated by an insulative layer. The rate at which the heat that is caused by the explosion of the cartridge, can travel down through the stainless-steel filaments contained in the weave layer is highly dependent on the wire diameter and the efficiency of the insulative factor of the interleaf. Due to the fact that the wire is a continuous filament compared to a resin filled with metallic particles, the heat transfer rate is significantly increased. In a primary example embodiment, a wire diameter of between about 0.001" to 0.002" is utilized. In other embodiments the thickness of the stainless-steel wire can range between about 0.001" and 0.010" depending on the overall wall thickness of the composite structure and the total amount of heat that needs to be transferred by the stainless-steel layers.

In example embodiments of the present invention, all of the composite layers located outboard of the last stainless steel weave ply consist of, comprise or include carbon fiber unidirectional prepreg except for the outer plies of a woven carbon fiber weave. These plies are oriented in the axial (bore) direction or longitudinal axis of the barrel tube. These plies play a large role in increasing the barrel stiffness and are attached in a manner that centers the pattern to the midpoint of the barrel diameter. Unlike the filament winding process which is limited to at best a 5 to 8 degree off axis capability in reference to the true longitudinal axis of the barrel, by utilizing unidirectional prepreg tape the plies can be placed in a true longitudinal orientation. By eliminating or substantially reducing the off-axis orientation of the carbon fiber, this increases the barrel stiffness and the compressive strength and the compressive modulus of the composite barrel itself. Since all or a substantial portion of the plies in the entire composite structure in example embodiments of the invention are wrapped with the center of the ply oriented in a true longitudinal direction and not off-axis, this means that the stainless-steel filaments located within the weave plies are also contributing significantly to the barrel stiffness. This is the primary reason that stainless steel is preferred versus aluminum or copper. Stainless-steel has an elastic modulus of 28 Msi whereas aluminum has an elastic modulus of 10 Msi or roughly ⅓ the stiffness of stainless-steel. Therefore, in the same given thickness and area of the composite barrel, the stainless-steel plies provide three times the axial (bore) stiffness compared to aluminum or two times the axial (bore) stiffness compared to copper which has an elastic modulus of 15 Msi.

During the filament winding process and after the curing of the polymeric resin, when the composite barrel cools down after the cure cycle it creates residual stresses in the laminate that are prone to twisting due to the limitation of the winding process. A rifle barrel that is made with this method is susceptible to barrel twist as the composite barrel begins to heat up and approaches the resin Tg. When this occurs, the residual stresses contained within the laminate will cause the material to change its stiffness and barrel straightness.

The final layer of composite material contained within the preferred embodiment, are multiple layers of a novel carbon flat tow weave that are oriented at a +/−45-degree angle relative to the axial (longitudinal) direction. By orienting this carbon fabric weave at this angle, it increases the torsional stiffness and reduces the torsional deflection associated with the torsional loads cause by the bullet passing through the rifling of the bore.

In example methods of manufacture, after all of the plies are wrapped in a center axis fashion around the steel mandrel, they are compacted using either spiral wound cellophane tape and cured in an oven or compacted and cured utilizing an autoclave or matched metal mold. In an example embodiment, the layup is cured using a cello wrapping process with cellophane tape and then cured at a temperature of about 300° F. After approximately a two-hour cure cycle, the composite barrel and mandrel are cooled down to ambient temperature where the composite tube is extracted from the mandrel. Once extracted from the mandrel, the composite barrel tube is trimmed to a final length and the surface is sanded to a smooth finish. The tube is now ready to be adhesively bonded to the actual steel rifle barrel.

The final steps in manufacturing a complete functioning rifle barrel with this novel composite rifle barrel are detailed herein according to example embodiments. The inside surface of the composite barrel tube is cleaned and prepared for bonding by using a cleaning solution and wire brush throughout the entire length of the barrel tube. This ensures that any excess mold release that transferred from the steel molding mandrel, is removed so that the epoxy adhesive used to bond the composite barrel to the steel rifle base has a clean surface. This process is also performed on the steel barrel liner that the composite barrel tube slips over and bonds to. Any sort of contamination on the steel rifle barrel liner or the inside of the composite barrel tube can cause delamination. Once the two parts are cleaned and prepared for bonding, a two-part epoxy adhesive is used to bond the two components together. In the preferred embodiment, an epoxy adhesive that has high thermal conductivity is applied in a spiral fashion extending from the breech to the muzzle end of the barrel. Once the adhesive is applied and the composite barrel tube is slipped into its final position, a removable tensioning nut is threaded onto the steel barrel liner and tightened to at least about 5 foot-pounds (or pound-foot) of force or torque, and in some example embodiments to at least about 10 foot-pounds (or pound-foot) of force or torque. Once the tube is fastened, it cures for a period of about two hours at ambient temperature and then cured in an oven for approximately one hour at a temperature of about 180° F. After the completed hybrid barrel is removed from the oven and cooled, it is ready to be assembled into the stock.

In one aspect, the invention relates generally to a barrel for a firearm. The barrel preferably includes a steel inner barrel liner, and a composite outer barrel sleeve comprising metallic fibers and non-metallic fibers, wherein the composite outer barrel sleeve is engaged around the steel inner barrel liner.

In another aspect, the invention relates to a method of manufacturing a firearm barrel. The method preferably includes applying a composite outer barrel sleeve incorporating metallic fibers and non-metallic fibers in engagement around a steel inner barrel liner.

In still another aspect, the invention relates to a barrel for a firearm. The barrel preferably includes a steel inner barrel liner having an external taper extending and tapering continuously from a larger breech end dimension to a smaller muzzle end dimension. The barrel preferably also includes a composite outer barrel sleeve having an internal taper configured to generally match the external taper of the inner barrel liner. The barrel preferably also includes a tensioning nut configured for engagement with the inner barrel liner and the outer barrel sleeve to place the inner barrel liner in tension and the outer barrel sleeve in compression.

In another aspect, the invention relates to a hybrid composite/steel barrel for a firearm. The barrel preferably defines a length extending in a lengthwise direction from a breech end to a muzzle end. The barrel preferably includes a steel inner barrel liner having a reduced material thickness relative to a standard firearm barrel of the same caliber. The barrel preferably also includes a composite outer barrel sleeve engaged around the inner barrel liner. The outer barrel sleeve preferably includes a woven metal mesh material having metallic fibers extending along the length of the barrel to conduct and dissipate heat in the lengthwise direction, and also includes carbon fibers.

In another aspect, the invention relates to a barrel for a firearm. The barrel preferably includes a metal inner barrel liner and a composite outer barrel sleeve. The composite outer barrel sleeve preferably includes at least one layer of woven metal mesh material comprising a plurality of metallic fibers, and at least one layer of carbon fiber material comprising a plurality of carbon fibers. The composite outer barrel sleeve is preferably engaged around the metal inner barrel liner.

In another aspect, the invention relates to a barrel for a firearm. The barrel preferably includes a metal inner barrel liner and a composite outer barrel sleeve engaged around the inner barrel liner. The composite outer barrel sleeve preferably includes a plurality of metallic fibers and a plurality of carbon fibers. Preferably, the inner barrel liner has an external taper from a larger breech end dimension to a smaller muzzle end dimension, the outer barrel sleeve has an internal taper configured to generally match the external taper of the inner barrel liner, and the barrel is assembled by press-fitting the internal taper of the outer barrel sleeve over the external taper of the inner barrel liner.

In another aspect, the invention relates to a firearm preferably including a barrel having a metal inner barrel liner and a composite outer barrel sleeve engaged around the inner barrel liner. The outer barrel sleeve preferably includes at least one layer of woven metal mesh material comprising a plurality of metallic fibers, and at least one layer of carbon fiber material comprising a plurality of carbon fibers. The firearm preferably also includes a stock portion attached to the barrel.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

BRIEF DESCRIPTION OF THE DRAWINGS

FIG. 18 is a chart showing the accuracy results comparing an all-steel barrel to the hybrid composite barrel according to an example embodiment of the current invention.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
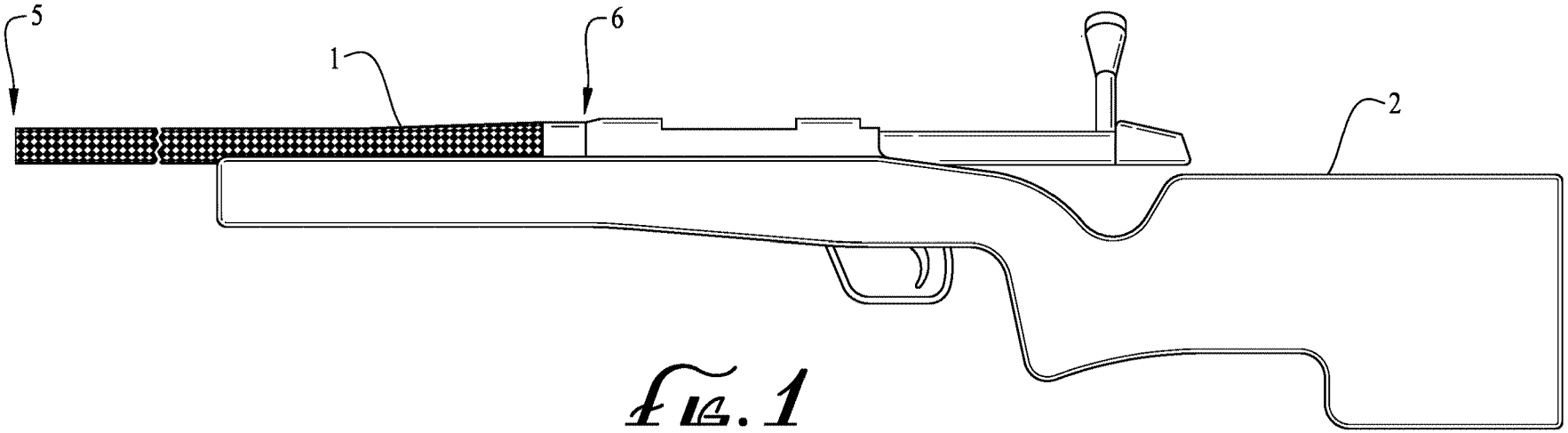
FIG. 1 is a side view of a firearm having a barrel according to an example embodiment of the invention, installed on a rifle stock.

With reference now to the drawing figures, wherein like reference numbers represent corresponding parts throughout the several views, FIG. 1 represents a rifle assembly 2 of a typical bolt-action sporting rifle which contains a rifle stock as is depicted in the drawing along with a rifle barrel 1 that is attached to the stock. The rifle assembly 2 is a type of rifle that is not limited to a caliber size, but is applicable to both rim fired cartridges and highly powered center fire rifles such as 0.308, 0.300 Win Mag, 6.5 Creedmoor calibers, as well as others. Although the primary focus of this invention has been focused on these types of rifles, the invention described herein is applicable to any firearm with a rifled or unrifled barrel including handguns and semi-automatic rifles. Also, while described and shown primarily with respect to example embodiments in the form of bolt action sporting and hunting rifles, the present invention may also be adapted to barrels for various other types of firearms, including without limitation, semi-automatic or automatic firearms, pump-action firearms, lever-action firearms, break-action firearms, falling block firearms, firearms operated by other actions, long guns, handguns, rifles, shotguns, cannons, and other types and formats of firearms. For this reason, the drawing depictions of and reference to a rifle assembly 2 will be understood as representing an exemplary but non-limiting embodiment for the novel concepts of this invention. Referring still to FIG. 1, the barrel assembly 1 may be characterized as a generally tubular construct centered around a longitudinal bore axis that has a breech end 6 and an opposite muzzle end 5.

Figure 2:
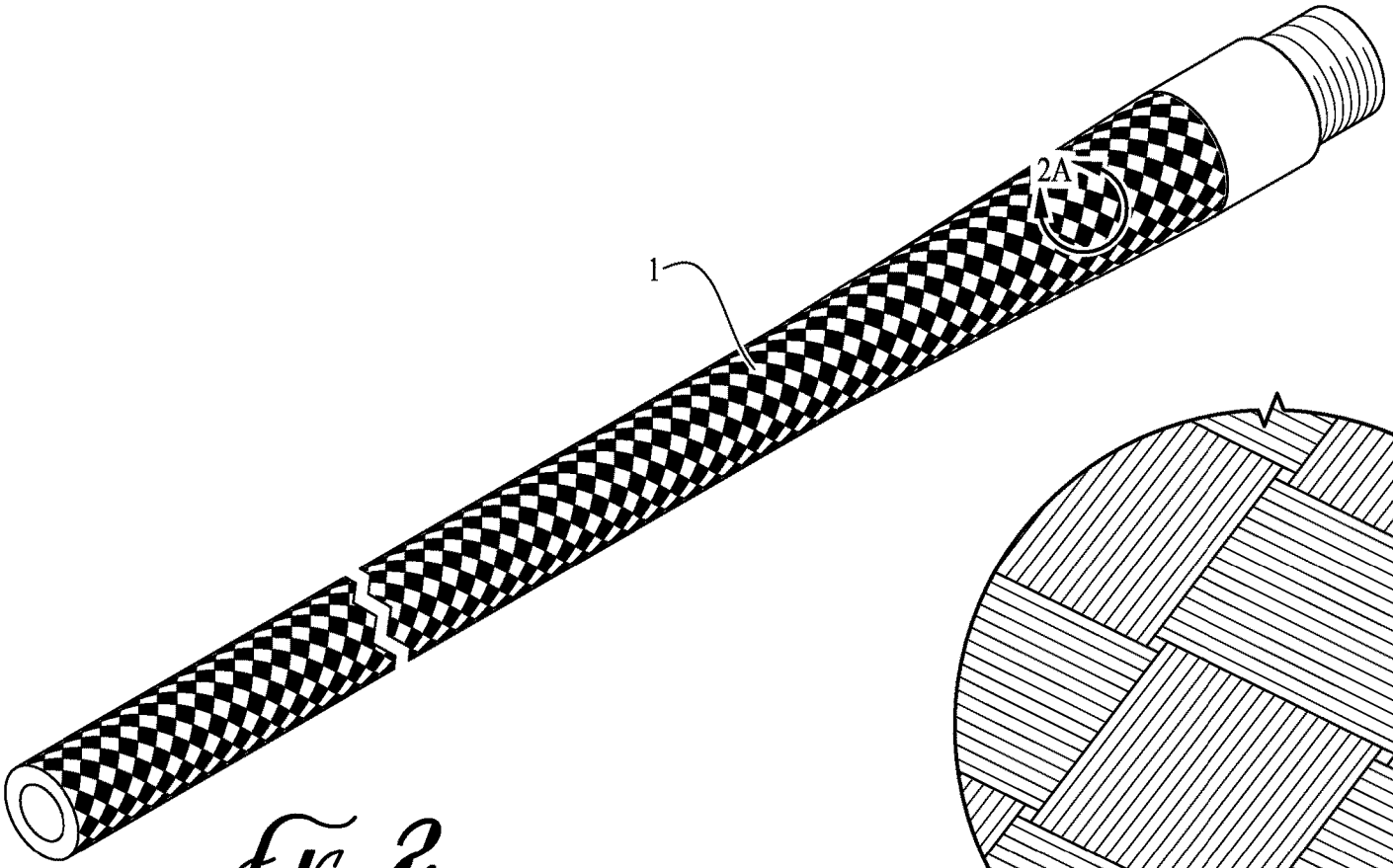
FIG. 2 is a perspective view of a firearm barrel according to an example embodiment of the invention.
Figure 2A:
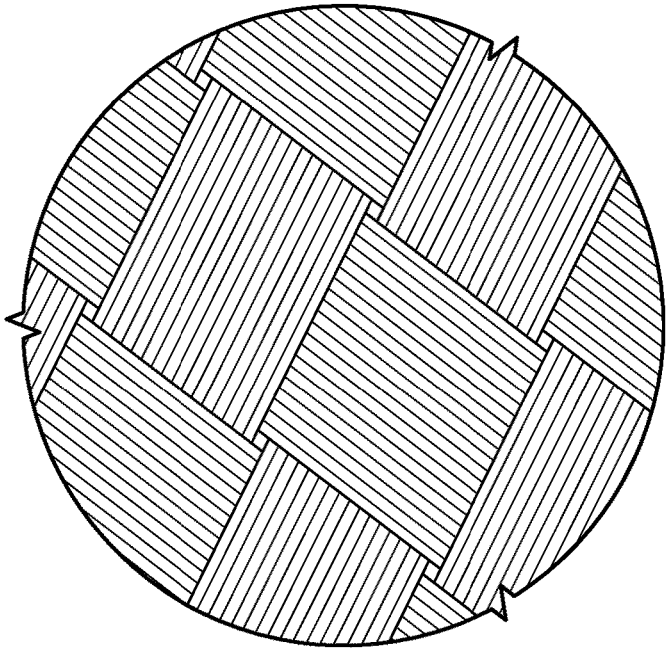
FIG. 2A is a detailed view of a portion of the barrel at the indicated location on FIG. 2.
Figure 3:
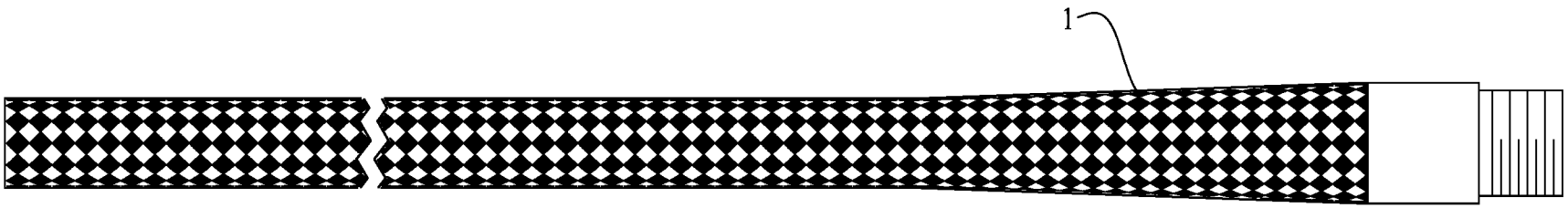
FIG. 3 is a first side view of the firearm barrel of FIG. 2.
Figure 4:
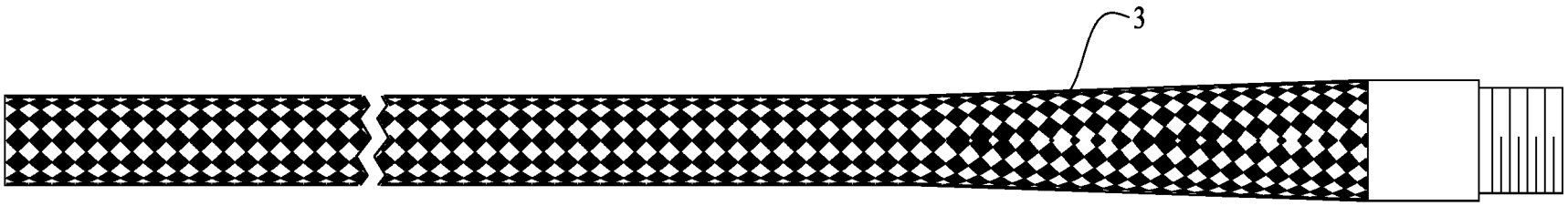
FIG. 4 is a second side view of the firearm barrel of FIG. 2.

FIG. 2 represents an isometric view of the composite barrel 1 which has been bonded to the steel barrel liner and shows that the composite barrel 2 section, extends from the breech end of the rifle assembly to the muzzle end of the rifle barrel. FIG. 3 is a top view of the composite barrel 1 while FIG. 4 shows the bottom view 3 of the composite barrel which is exactly 180 degrees opposed to the top view 1. One can see that in view 3, the fibers contained in the outer carbon weave which is oriented at a +/−45-degree fiber angle in reference to the longitudinal axis of the composite barrel come together and form a seam line. This seam line is then oriented so that it is hidden from view by fixturing the composite/steel barrel 1 into the bottom channel located in the stock 2 and thusly is not seen by the consumer.

Figure 5:
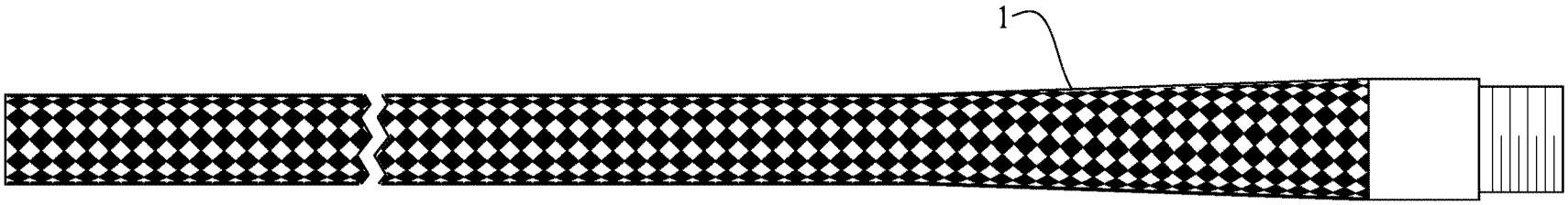
FIG. 5 is a top view of the firearm barrel of FIG. 2.
Figure 6:
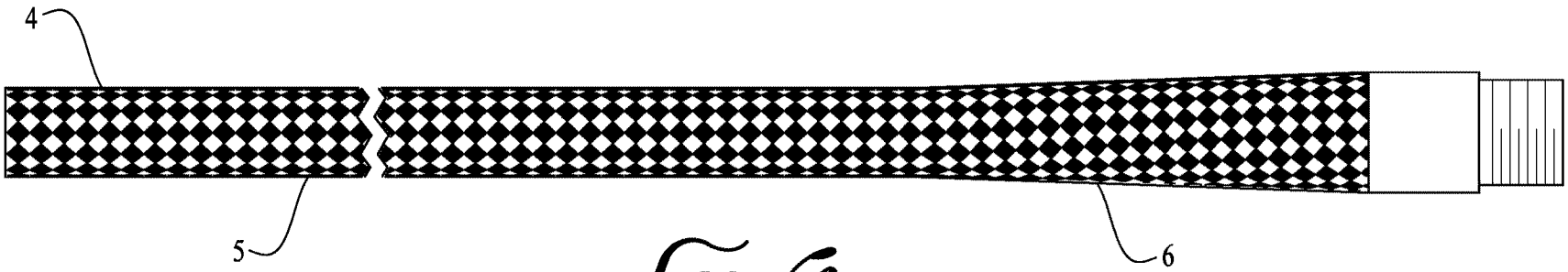
FIG. 6 is a bottom view of the firearm barrel of FIG. 2.
Figure 7:
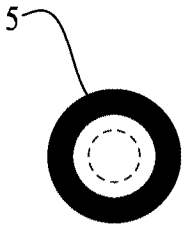
FIG. 7 is a first or muzzle end view of the firearm barrel of FIG. 2.
Figure 8:
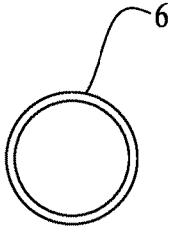
FIG. 8 is a second or breech end view of the firearm barrel of FIG. 2.
Figure 9C:
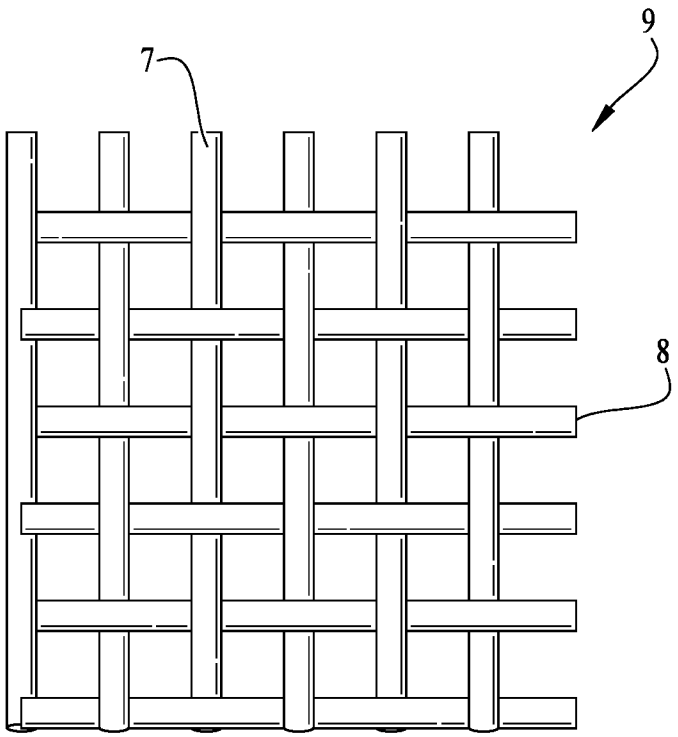
FIGS. 9A, 9B, 9C and 9D are isometric, side, top, and end views of a woven wire mesh construction according to an example embodiment of the invention.
Figure 9B:
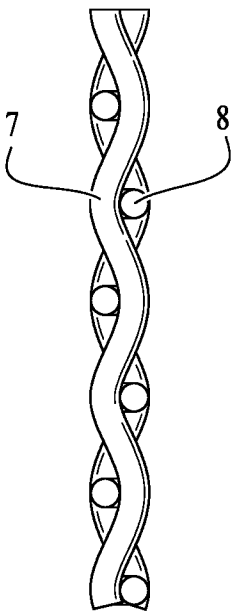
Figure 9A:
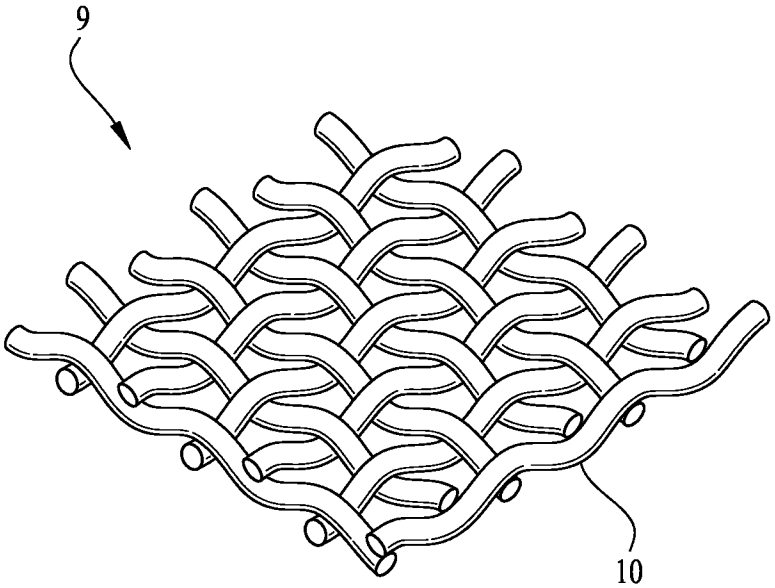
Figure 9D:
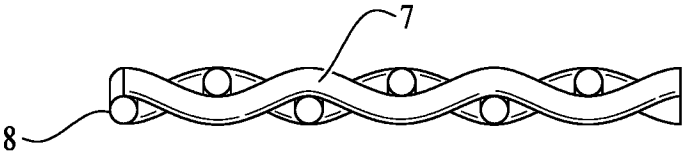

FIGS. 5 and 6 represent a side view and the location of a cut away cross-sectional view 4 of the composite barrel assembly 1. FIGS. 7 and 8 are cross-sectional views of the muzzle end (FIG. 7, element 5) and the breech end (FIG. 8, element 6) of the hybrid composite/steel barrel. The radial wall thickness 5 is represented in FIG. 7 where it shows the inner steel barrel liner represented by dotted lines that form a circle. Detail 6 represents the breech end of the hybrid composite/steel barrel where the barrel is 100% steel construction. This demonstrates that the radial wall thickness can increase or decrease along the longitudinal axis of the barrel depending on factors such as burst strength, heat and stiffness driven requirements.

FIG. 9 (FIGS. 9A, 9B, 9C and 9D collectively) contains a variety of views detailing the construction of the metal mesh weave. In an example embodiment, the reinforcing layer 9 is a sheet of metal mesh with an 80 times 80 wires per inch with a wire diameter of 0.001-0.002 inches. In the example embodiment, the reinforcing layer 9 is a stainless-steel mesh. The pattern of the steel mesh is a plain weave where the warp wire 7 (wire running-parallel to length of the mesh material) passes alternately over and under the wires running transversely 8 through the mesh material (fill or shoot wires) at 90-degree angles. Reinforcing layer 9 is oriented where the warp wire 7 is parallel with the longitudinal axis 1 of the composite barrel and the fill wire 8 is perpendicular to the longitudinal direction. By orienting the mesh in this particular manner, the 90-degree (from bore axis) fiber orientation of the carbon fiber hoop ply reinforcing layer 10 provides additional hoop strength to the composite barrel 1. It is contemplated that the angle of the mesh wires may be varied according to application and desired overall strength of the composite barrel 1. It is further contemplated that the number of wires per inch and wire diameter may be changed to fit the strength characteristics and thermal characteristics desired for the composite barrel 1. The type of metal used for the metal mesh is not meant to be limiting and the determination of type of metal used will be determined by the strength, stiffness and thermal heat transfer characteristics desired for the composite barrel 1. It is also contemplated that the reinforcing layer 9 may be made of alternative types of materials besides metal. U.S. patent application Ser. No. 17/165,721 (U.S. Patent Pub. No. US 2021/0252352 A1) filed Feb. 2, 2021, and U.S. Prov. Pat. App. Ser. No. 63/086,017 filed Sep. 30, 2020, are hereby incorporated herein by reference in their entireties.

Figure 10A:
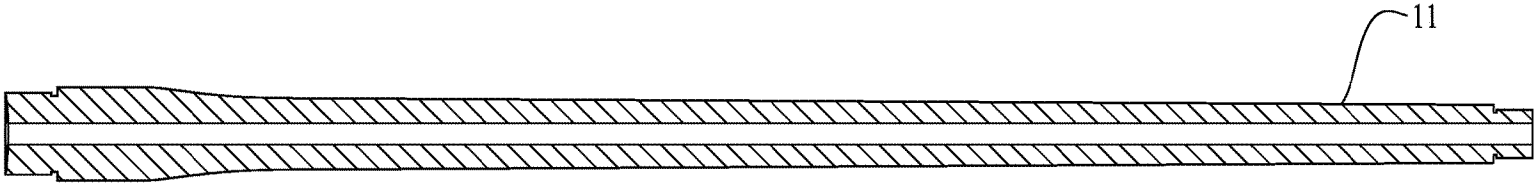
FIGS. 10A, 10B, 10C and 10D are cross-sectional views of the longitudinal axis of the initial steel barrel profile, the machined barrel profile, the composite barrel profile and the finished hybrid barrel according to example embodiments of the invention.
Figure 10B:
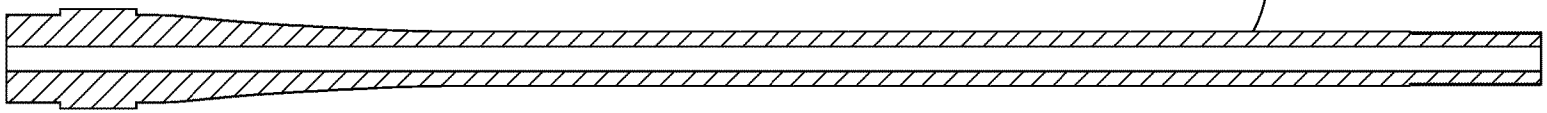
Figure 10C:
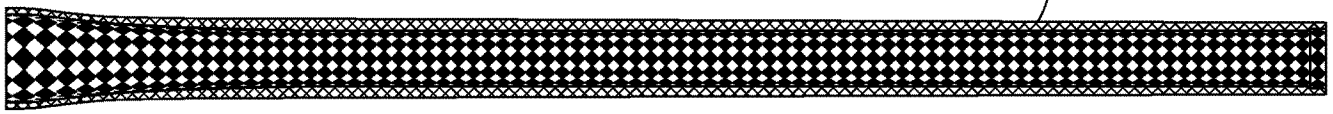
Figure 10D:
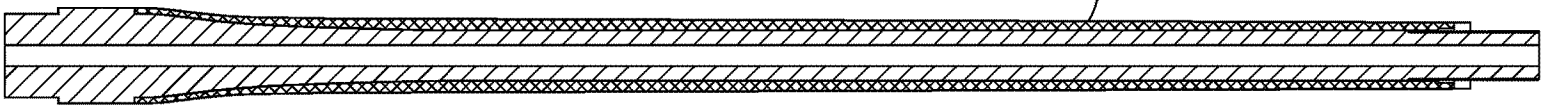

FIG. 10A represents a longitudinal sectional view of the steel barrel in its original dimensions and profile 11; FIG. 10B represents a steel barrel that has been machined down to a profile that will accept the composite barrel tube, also referred to as the inner barrel liner 12; FIG. 10C represents a composite hollow tubular barrel or outer barrel sleeve 13; and FIG. 10D represents the completed hybrid barrel 14 with the composite hollow tube or outer barrel sleeve 13 bonded to the machined down steel inner barrel liner 12. In some example embodiments, the internal wall of the steel barrel 12 has rifling on the inside that extends from the breech end 6 to the muzzle end 5. In alternate embodiments, the inner barrel liner 12 may comprise various types or grades of steel including carbon steel and/or stainless steel, other metals, ceramics, high-temperature polymers, and/or other materials. The profile dimensions of the steel barrel 12 are duplicated to the inner diameter of the composite barrel tube 13 with the exception of the diameters. To accommodate a sufficient amount of thermally conductive adhesive between the composite barrel tube 13 and the machined down steel barrel 12, the inner diameter of the composite barrel tube 13 may be increased by about 0.005" over the outer dimensions of the machined down steel barrel 12 in the preferred embodiment. This bondline gap is preferably generally constant throughout the entire longitudinal axis of the bore extending from the breech end 6 to the muzzle end 5. The radial wall thickness can vary from the breech end of the composite barrel tube 13, to the muzzle end. In some example embodiments, the steel barrel liner is machined down from a standard firearm barrel by removing a portion of the standard barrel's exterior material to form a reduced barrel material thickness relative to the original material thickness of the standard firearm barrel from which it was formed. In other example embodiments, the barrel liner is originally fabricated with a reduced barrel material thickness relative to a standard firearm barrel of the same caliber and/or barrel format.

In this manner, the barrel liner has a substantially reduced weight relative to a standard steel firearm barrel of the same caliber and/or barrel format. Some or all of the materials from which the composite barrel tube are formed preferably have a lower material weight or density than the steel material of the barrel liner, whereby the overall hybrid barrel assembly is lighter in weight than a standard firearm barrel of the same caliber and/or barrel format. In some particular examples, the machined down inner barrel liner 12 has an outside diameter of at least about 20% less, and in further examples at least about 30% less than the barrel outside diameter of a standard or commercial average steel barrel of a firearm of the same caliber and type. For example, for a 6.5 Creedmoor barrel, a standard steel barrel diameter may be about 0.941" (23.90 mm), whereas a steel inner barrel liner according to some example embodiments of the present invention may have a diameter of about 0.625" (15.87 mm); i.e., the outside diameter of the barrel liner is about 66% or ⅔ the outside diameter of the standard steel barrel (about 34% or ⅓ less). In another example, a standard or commercial average steel .30 caliber rifle barrel may have a barrel wall thickness (bore to outside diameter, measured at 12 inches from muzzle) of about 0.287" (7.289 mm), whereas a steel inner barrel liner of the same caliber according to an example embodiment of the present invention may have a barrel wall thickness of about 0.162" (4.114 mm); i.e., about 56% the steel barrel wall thickness, or about a 44% reduction in steel barrel wall thickness. In terms of weight, in some example embodiments, the hybrid composite barrel of the present invention may have an overall weight of at least about 10%-15% less, and in further examples at least about 20-25% less, and in further examples at least about 30-35% less, than the overall weight of a standard or commercial average steel barrel of a firearm of the same caliber, barrel length and format (firearm type). In further example embodiments, barrel weight may be reduced by up to 50% or more. In particular examples, a standard or commercial average steel .30 caliber rifle barrel may have a weight of about 60.53 oz (1716 g), whereas a hybrid composite barrel of the same caliber and barrel length according to an example embodiment of the present invention may have a weight of about 40.25 oz (1141 g); i.e., about 66% (⅔) the weight, or about a 33% (⅓) reduction in overall barrel weight.

Figure 11:
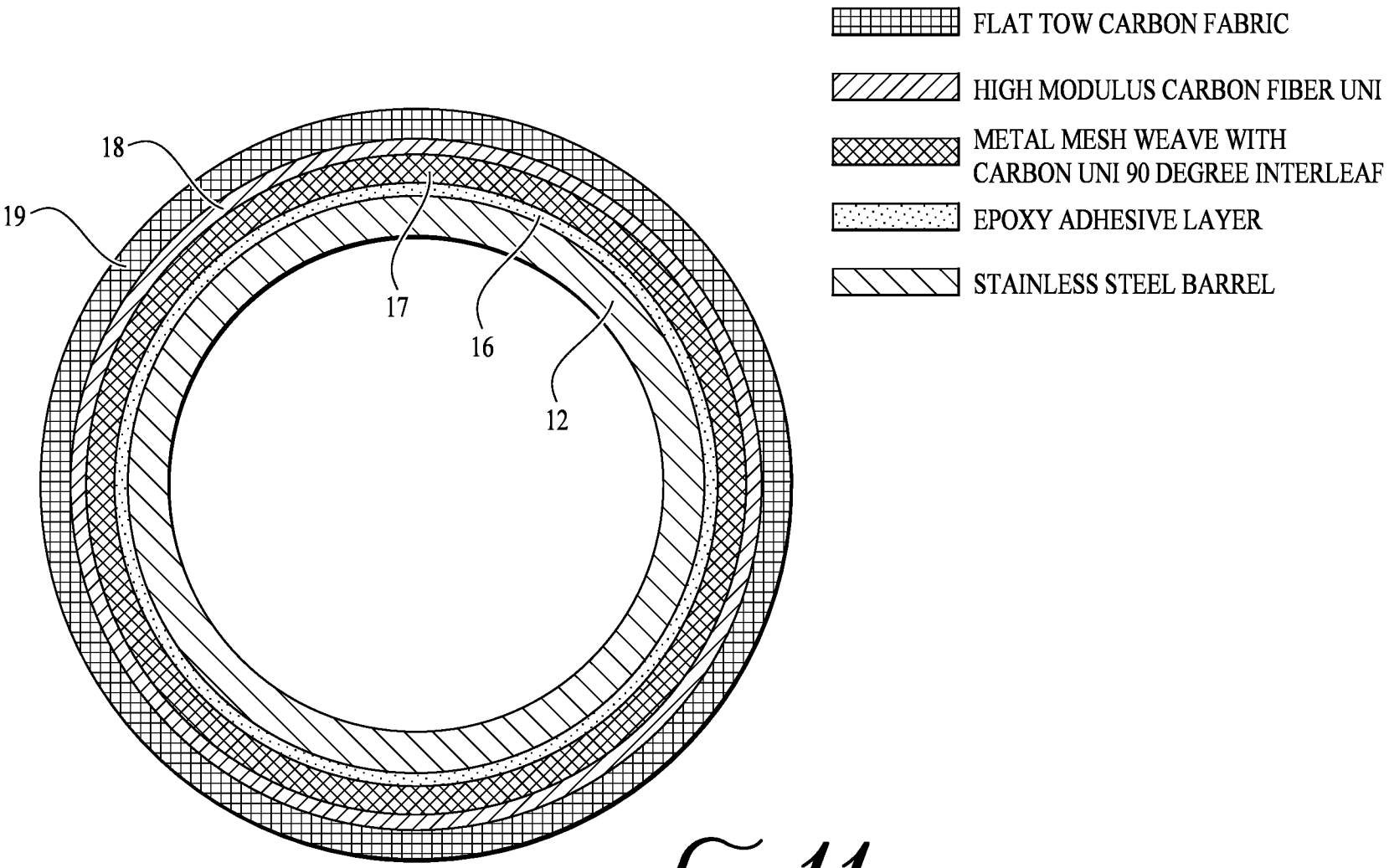
FIG. 11 is a cross-sectional end view of the muzzle end of a composite barrel according to an example embodiment of the invention detailing the various layers of the composite and steel barrel liner.

FIG. 11 is a transverse cross-sectional view of the hybrid composite/steel barrel assembly (1,14) showing the steel barrel liner 12 in addition to all of the composite layers 16, 17, 18 and 19 outbound of the steel barrel liner 12. Beginning at the inner barrel steel core 12, the subsequent composite layers 16, 17, 18 and 19 consist of pre-impregnated fiber and fabric reinforcement with a polymeric resin. Unlike many previous approaches that utilize a filament winding process whereby individual fiber tows are wound around a steel mandrel, example embodiments of this invention use 100% prepreg which is then cut into precise circumferentially wrapped discrete layers. The steel barrel 12 wall thickness can vary depending on the type of round being fired due to the fact that both the heat and stresses generated by the explosive force of firing the cartridge will vary. Hence, the greater the explosive force and heat generated, the thicker the steel wall thickness will be. In example embodiments, the steel barrel 11 will be machined down to form a new thinner barrel core, liner or sleeve 12 that will accept the composite barrel tube. The amount of steel removed from the original steel barrel 11 is dictated by the minimum amount of steel that can withstand the explosive forces of the explosion event. Once the amount of material to be removed has been calculated, a new profile is created 12 and a mandrel is then designed to match the outer diameter of said new barrel profile 12 plus the addition of the 0.005" for the bondline thickness. In alternate embodiments, the steel barrel liner 12 is initially fabricated with the reduced thickness, rather than machined down from a greater thickness. In some embodiments the barrel liner 12 has a rifled internal bore comprising helical grooves or other surface features (e.g., for use as a rifle or handgun barrel), and in other embodiments the barrel liner has a smooth internal bore (e.g., for use as a shotgun barrel).

Moving on to the subsequent plies 16, 17, 18 and 19, ply 16 is the layer of thermally conductive adhesive 16 which bonds the outer composite barrel tube to the inner, optionally rifled, steel barrel 12. Section 17 are the first plies that come into contact with the steel barrel liner 12 are that of the metal mesh weave 9 with the carbon fiber prepreg interleaf 23. In example embodiments, this section of the wall thickness is comprised of 4 layers of the stainless-steel weave 9 and the carbon fiber prepreg 23 which forms the interleaf and is rolled as a single layer. Each layer is oriented at 90-degree starting point intervals so that any overlap of the patterns will blend into the surrounding layers and reduce the amount of wall thickness variations. The plies in section 18 consist of carbon fiber prepreg oriented in a longitudinal axis where the elastic modulus of the carbon fiber ranges from 33 Msi to over 60 Msi. The fiber type chosen is dependent on performance factors and cost factors, however the preferred embodiment utilizes a ratio of 75% high modulus fibers (e.g., 60 Msi tensile) and 25% standard modulus fibers (e.g., 33 Msi tensile). The final section 19 consists of a novel flat tow carbon weave, for example as shown in the detail 2A of FIG. 2, that exhibits very high translation properties due to the fact the fiber tow is spread in a flat shape verses a typical round shape associated with most woven fabrics. These layers 19, are oriented at a +/−45-degree fiber angle relative to the longitudinal (bore) direction of the composite tubular barrel 13. In example embodiments, the +/−45-degree fiber angle is the optimum fiber angle for controlling the torsional deflection of the composite barrel tube. Therefore, this reduces the torsional deflection of the overall rifle barrel thusly reducing the barrel twist typically associated with rifled gun barrels. In alternate embodiments, different offset angles may be utilized between layers, for example, within a range of about +/−30 degrees to 60 degrees relative to the longitudinal bore axis direction.

Figure 12:
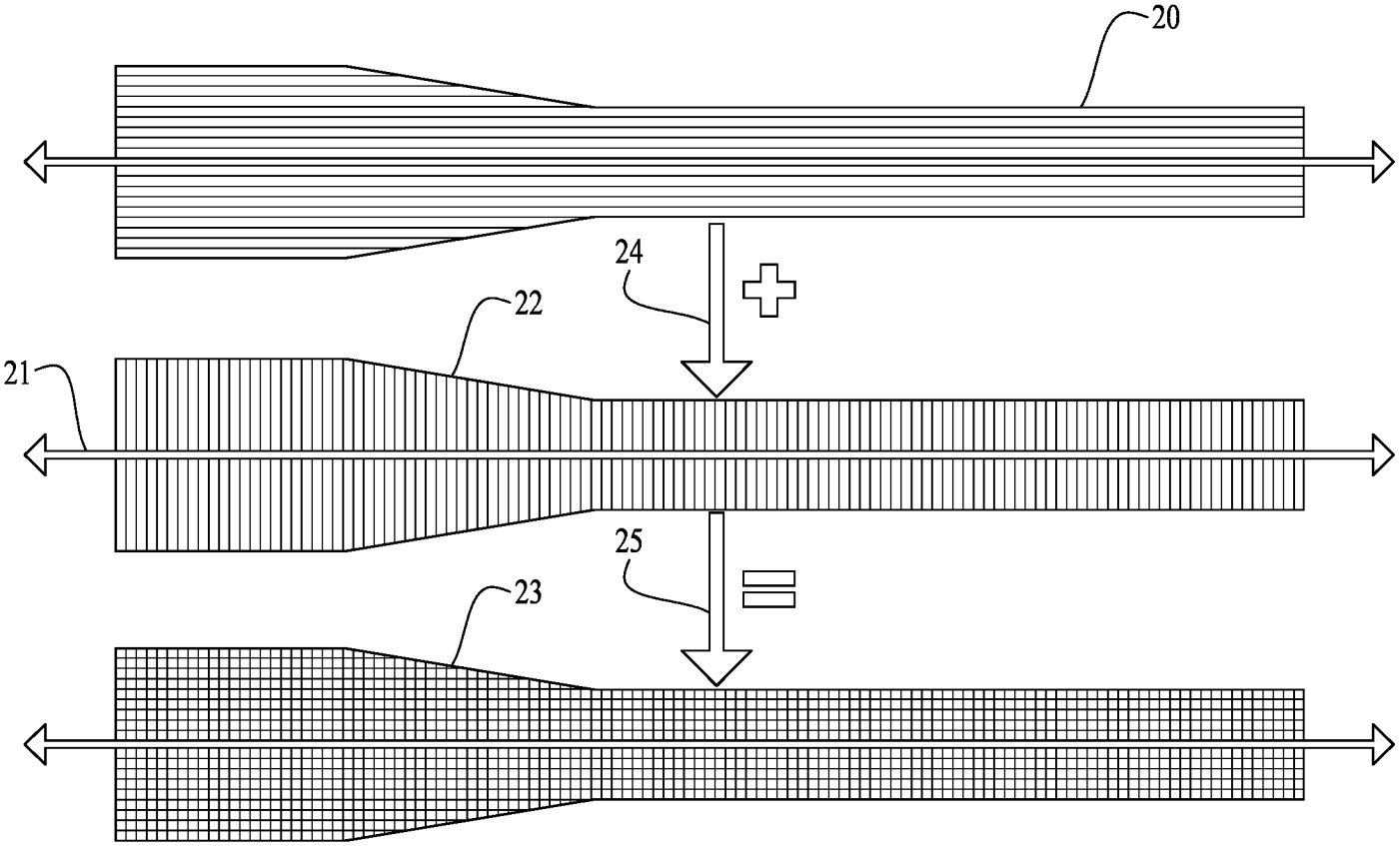
FIG. 12 is a view of the composite pattern layers of the stainless-steel woven mesh and the carbon fiber composite interleaf layer of a composite barrel according to an example embodiment of the invention.
Figure 13:
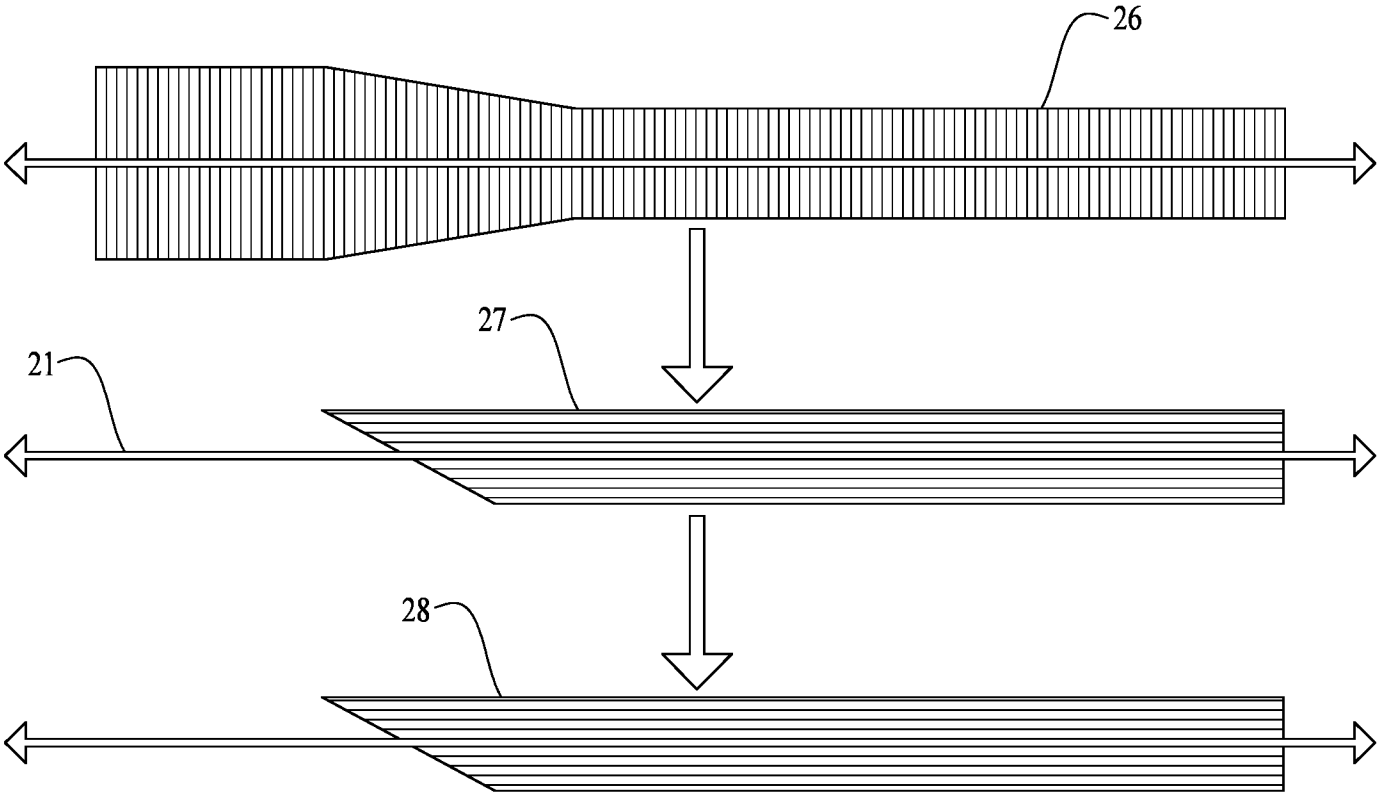
FIG. 13 is a view of the composite pattern layers of the carbon fiber composite layers outboard of the stainless-steel layers of a composite barrel according to an example embodiment of the invention.

FIGS. 12-13 represent an illustrative top view of composite material patterns for a reinforced composite barrel tube 1 is shown. The unidirectional carbon fiber prepreg 22, 26, 27, 28 and 29 along with the metal mesh weave 9, 20 material can be cut into patterns which are then rolled and formed into the finished composite barrel tube. Carbon fiber manufacturing techniques that may be utilized include the wrapping of carbon fiber prepreg around a mandrel which is then heated and formed into the desired article of manufacture. The composite barrel tube can be formed by rolling a first metal mesh weave 9 prepreg around a mandrel to form a thermally conductive core. This core is represented by patterns 20, 22 and 24 whereas the first ply in the ply sequence is one of the desired metal mesh weave 20. Due to the thin and flexible nature of this novel metal mesh weave 20, ply 20 is attached 24 to a ply of unidirectional carbon fiber prepreg that is oriented at a 90-degree fiber orientation 22 relative to the longitudinal (bore) direction of the composite tubular barrel 1. Apart from providing stability during the rolling process of the composite barrel tube 1, this ply 24 provides an interleaf which separates the individual metal mesh weave plies 9 contained in the overall wall thickness. This layer 22 provides an insulative layer between each one of the metal mesh weave plies 9 which provides an excellent pathway for conducting and dissipating the heat generated by the explosion of the cartridge to quickly and efficiently transfer heat from the breech end 6 of the rifle barrel to the muzzle end 5, and dissipating the heat to the ambient surroundings. The combined layers 25 of the metal mesh weave 9 and the carbon fiber prepreg 22 oriented at a 90-degree orientation relative to the longitudinal (bore) axis represent a single ply. In the preferred embodiment, there are 4 plies of the interleafed combined prepreg 25 which are attached in 90-degree increments circumferentially around the hoop axis of the composite barrel tube. In other embodiments, the number of plies 25 can vary based upon the caliber size, the heat generated during the explosion of the propellant, wall thickness limitations, desired barrel stiffness among other critical design considerations. In some example embodiments, the hybrid composite—steel barrel is fabricated by forming the steel inner barrel liner and wrapping the composite materials onto the liner to form the composite outer barrel sleeve. In other embodiments, the hybrid composite—steel barrel is fabricated by separately forming the composite outer barrel sleeve on a mandrel as detailed below, and then press-fitting the completed outer barrel sleeve onto the steel inner barrel liner.

Figure 14:
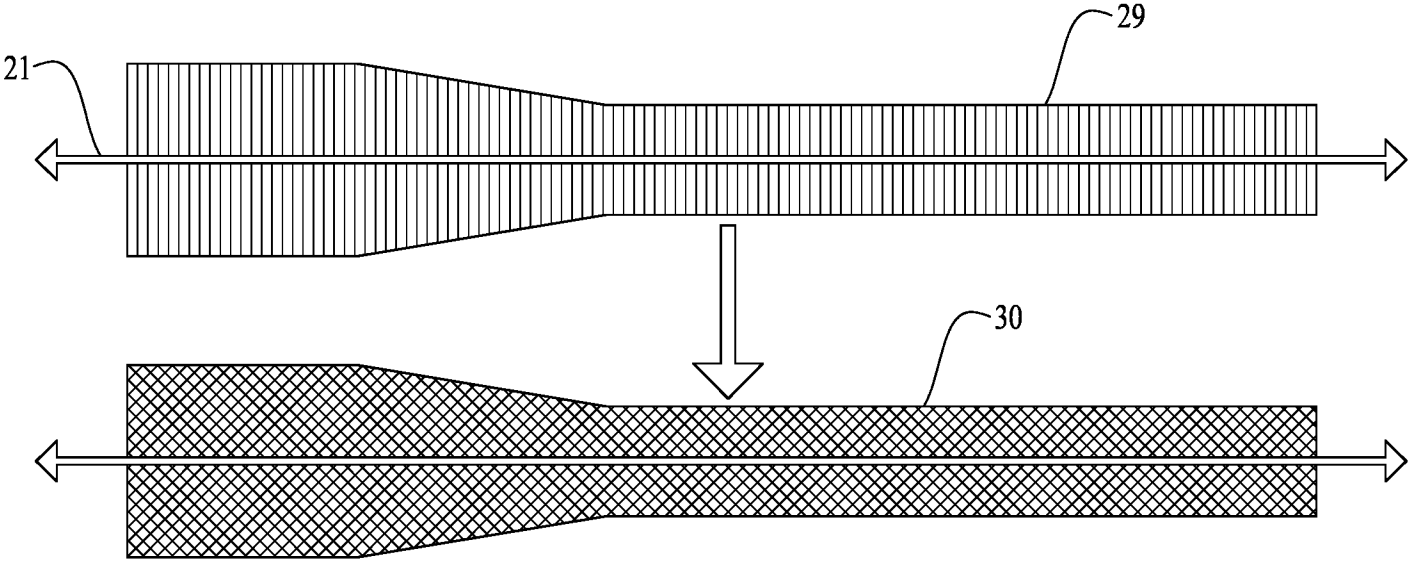
FIG. 14 is a view of the composite pattern layers of the carbon fiber composite including the carbon fiber fabric weave on the outside of the composite barrel according to an example embodiment of the invention.

FIGS. 12, 13 and 14 represent a variety of patterns of two-dimensional profiles. These profiles closely match the dimensions and taper rates of the inner composite barrel tube 1 profile. By matching the outer diameter and profile taper rates of the mandrel and the subsequent plies that are rolled around the mandrel, it assures that each ply is a fully concentric wrap with no gaps and minimal ply overlaps. This provides for a uniform composite wall thickness (See FIG. 11) both circumferentially and longitudinally which significantly reduces the residual stresses in the laminate after the composite material has been fully cured. Maintaining a true 0-degree longitudinal axis with the carbon fiber prepreg 26, 27, 28 and 29 and the steel filaments contained in the metal mesh weave 9, maintains the composite barrel tube straightness and thus accuracy of the overall weapon system 2. The filament winding process referenced in the background disclosed examples cannot achieve a 0-degree fiber alignment due to the limitations of the filament winding process. At best, the filament winding process can apply unidirectional fibers at a 5 to 8 degree off axis orientation relative to the longitudinal (bore) axis. In a filament wound composite rifle barrel, this limitation translates into accuracy issues which are exacerbated when the barrel begins to heat up due to repeated firing events.

Additionally, FIGS. 12, 13 and 14 show arrows which represent the centerline axis 21 of the composite prepreg patterns. During the rolling process of the patterns (FIGS. 12, 13, 14), the centerline 21 of the pattern is rolled at the midpoint of the mandrel cross-sectional diameter. By doing this helps ensure that the individual fiber orientation maintains its directionality and provides for a uniform seam joint when the trailing edge of the pattern meets up with the leading edge (attached first) of the pattern.

FIG. 13 is a top view of example embodiment pattern profiles of the stiffness and load carrying longitudinal (bore) plies 26, 27, 28 and 29. FIGS. 13 and 14 do not reflect the actual number of these plies in the example embodiment disclosed, but are examples of what these shapes consist of. For instance, ply 26 is a full-length ply that extends in a continuous fashion from the breech end 6 to the muzzle end 5. Plies 27 and 28 represent shorter length plies that extend from the muzzle end to the point at which the composite barrel tube 1 begins to increase in diameter located in the taper region of the composite barrel tube 1. This allows the composite barrel tube to have different wall thicknesses at the breech end 6 and at the muzzle end 5. The carbon fiber materials contained in these plies 26, 27, 28 and 29 can range in stiffness and are chosen based upon desired composite barrel tube 1 performance factors such as; stiffness, weight, cost etc. In example embodiments, the fibers contained within these plies 26, 27, 28 and 29 are considered "High Modulus" PAN (polyacrylonitrile, $(C_3H_3N)_n$) based fibers with an Elastic Modulus of, for example, between about 55 Msi and 60 Msi (million pounds per square inch).

FIG. 14 is a top view of representative pattern shapes for both the stiffness critical plies 29 and the final last layer plies 30 which are made up of a novel flat tow carbon fabric weave. In example embodiments, these layers 30 are oriented at a +/−45-degree fiber angle which provides for higher torsional stiffness compared to the same material that is oriented along the 0-degree longitudinal (bore) axis. This helps reduce the twisting effect in the composite barrel tube 1 which increases the accuracy of the firearm and reduces the standing wave vibrations that migrate through the composite/steel hybrid barrel 14 when the weapon is fired.

Figure 15:
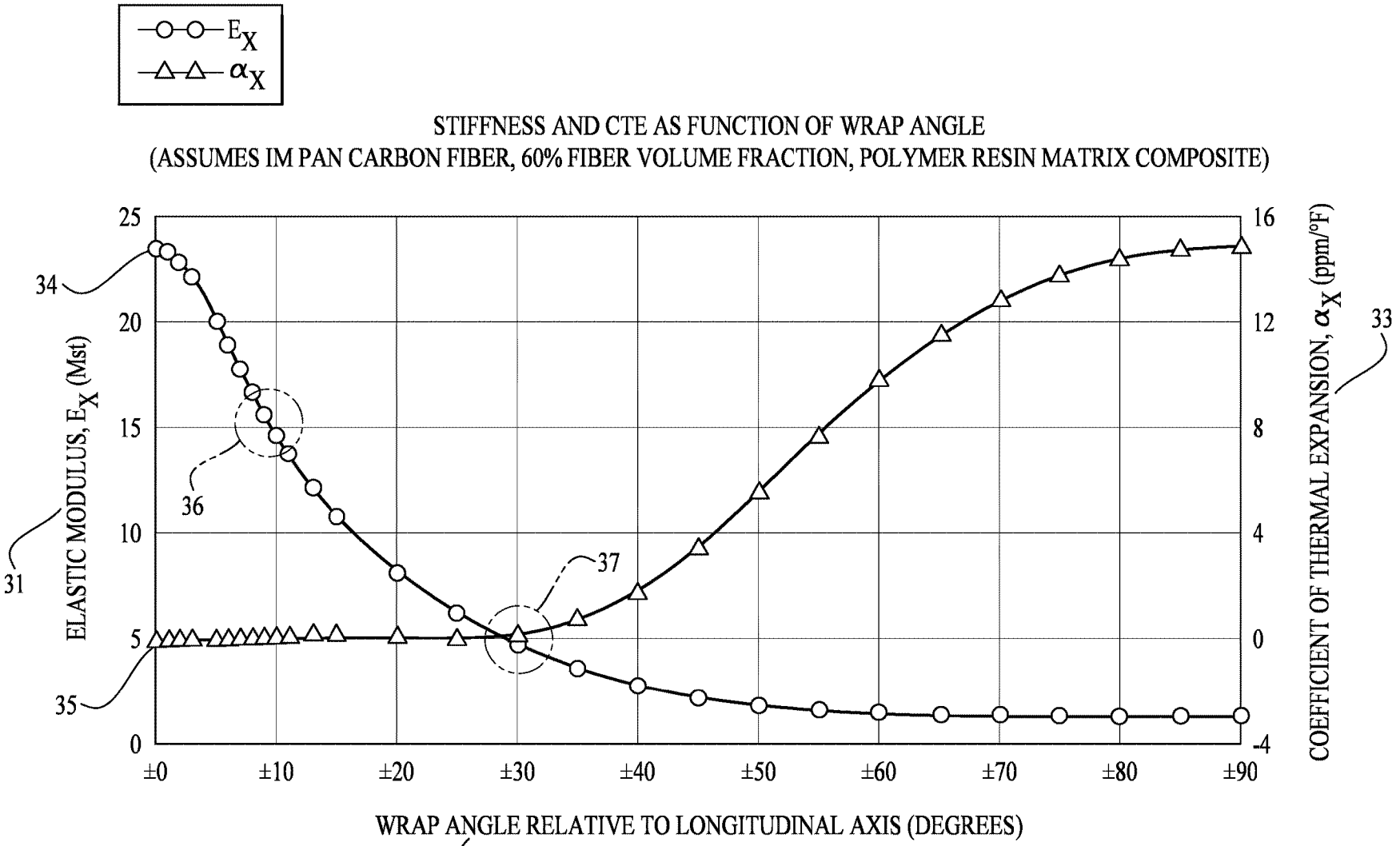
FIG. 15 is a chart with plots for both the elastic modulus and thermal expansion of carbon fiber using a filament winding process according to an example embodiment of the invention.

FIG. 15 is a graphical representation that shows plots of the carbon fiber stiffness 3, the Coefficient of Thermal Expansion (CTE) 33 with the wrap angle of the carbon fiber relative to the longitudinal (bore) axis 32. As mentioned earlier, the method of manufacturing with example embodiments is whereby the material form for both the carbon fiber 22 and the metal mesh weave 9 is a pre-impregnated (prepreg) form whereby the polymer resin is applied in a uniform format creating a continuous roll at a width that contains multiple fiber tows across the prepreg web. Unlike the filament winding process where individual tows are wound in a helical fashion around the mandrel and where the fiber orientation is at best 5 to 8 degrees off axis from the longitudinal axis (bore) direction. This chart demonstrates one of the inherent weaknesses of filament winding with respect to the Elastic Modulus of the fiber. The X-Axis 31 located on the left-hand side of this chart represents a graduated axis that is the Elastic Modulus of the fiber. The Y-Axis 32 located at the bottom of this chart shows the different wind angles of the carbon fiber relative to the longitudinal axis (bore) axis. The X-Axis located on the right-hand side of this chart 33 represents the Coefficient of Thermal Expansion as it relates to the wind angle of the carbon fiber. The material used to create this chart is an Intermediate Modulus PAN based carbon fiber that has been combined with a polymeric resin and cured with a fiber volume normalized to 60% fiber volume fraction. The Y-Axis 32 starts at a 0-degree wind angle and progresses to a wind angle of 90 degrees. The 0-degree start point is the True Longitudinal Axis (bore) of a structure or in this case the bore direction of the rifle barrel 1. The 90-degree end point represents the hoop direction of the wind pattern which is transverse to the longitudinal (bore) direction.

Beginning with the plot of the Elastic Modulus 34, the starting elastic modulus (longitudinal stiffness) with this material begins with a value of roughly 23 Msi. As the fiber is wound at different angles, one can see that the elastic modulus of the fiber begins to drop off suddenly relative to the longitudinal axis 32. Detail 36 shows an exploded view of the elastic modulus plot at the point in which filament winding would start due to the limitations of the filament winding process. As mentioned, the best fiber alignment possible with filament winding is between 5 to 8 degrees off-axis. The use of unidirectional prepregs combined with the novel techniques described and portrayed in FIGS. 12, 13 and 14, allow for zero off axis fiber alignment relative to the longitudinal axis (bore) 32. The reduction in fiber stiffness is very dramatic as is portrayed in this chart. By having a process that inherently places the carbon fiber at an off-axis position of 5 to 8 degrees, the elastic modulus of the carbon fiber composite is reduced from 23 Msi down to approximately 15 Msi (33% reduction) 36. These plies are the critical plies that control the stiffness and the straightness of the composite tubular rifle barrel tube 1. To compensate for this reduction in stiffness, filament wound composite barrels require additional carbon fiber material to achieve a similar stiffness compared to using the preferred unidirectional prepreg materials. The fact that the composite structure 34 is off-axis to begin with creates an inherent residual stress in the laminate that is prone to movement under load which is then compounded when the resin matrix heats up due to the explosion of the cartridge. This creates accuracy issues with a rifle barrel in addition to increasing the bullet impact location migration (FIG. 17) associated with a barrel that is fired cold and a barrel that is fired when it is hot. In essence, by maintaining the carbon and steel weave filaments in a true 0-degree axis relative to the longitudinal axis (bore), the composite barrel 1 stiffness and straightness is increased and less suspectable to bending and twisting when the barrel 1 is heated due to firing. As this plot progresses to the point where the wind angle of the fiber approaches the 90-degree off-axis angle, the elastic modulus 34 depicted is that of the polymer resin which has an elastic modulus of around 3 to 5 Msi.

Turning to the plot of the CTE 35 which details the amount the carbon fiber composite increases or decreases in both the X and Y dimensions as a function of wind angle. In this case, the amount of thermal expansion is the greatest at wind angles of 90-degrees off-axis versus the lowest and even negative when the wind angle is at 0-degrees off axis. This is due to the fact that the 90-degree off-axis values are resin dominate properties versus the 0-degree off-axis values which are fiber dominant properties which explains the negative CTE 35. Where these two lines 37 intersect, it shows that the CTE is very consistent until the fiber angle reaches approximately 30 degrees relative to the longitudinal axis (bore) 32. In example embodiments, there are only three different fiber angles utilized relative to the longitudinal axis (bore) 32. These different angles include 0, 90 and the outer plies at +/−45-degree angles. Alternate embodiments can have varying fiber angles other than the three utilized in the disclosed primary embodiment. A significant factor regarding the CTE 33, is that if the CTE 35 values associated with the different materials throughout the entire composite structure (FIG. 11) have a large difference between them, it causes the different plies to expand or contract more relative to each other and this causes shear stresses between the plies. These shear stresses if large enough can cause micro-cracking within the polymer resin and lead to premature composite failure. Therefore, choosing the appropriate materials and orienting them in a way to achieve similar CTE's 33 between the composite layers (FIG. 11) is a key design consideration. This is how it was determined that the optimum fiber angles for the preferred embodiment are 0, 90 and 45 degrees relative to the longitudinal axis (bore) direction.

Figure 16:
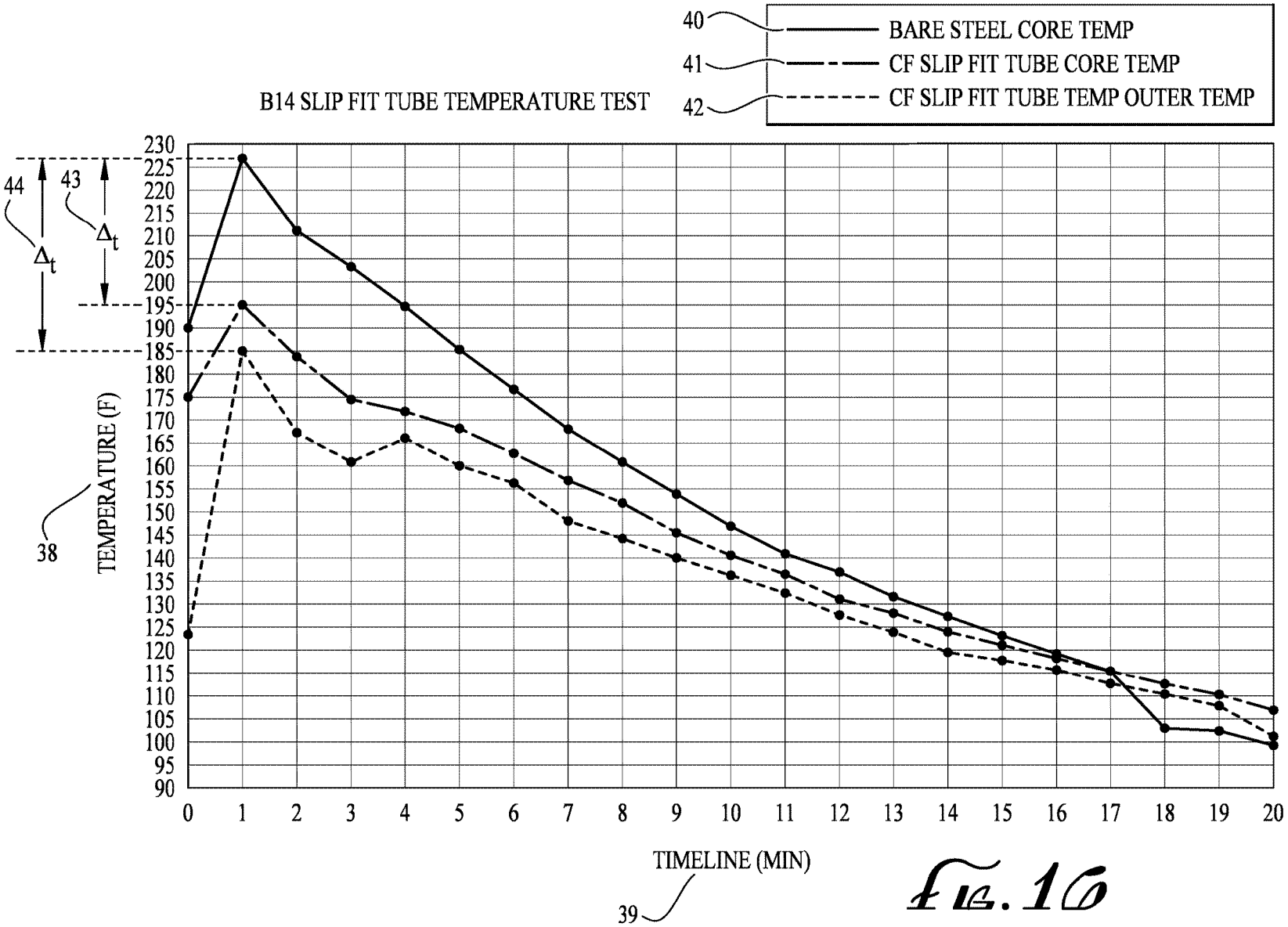
FIG. 16 is a chart of thermal profiles for both an all-steel barrel in addition to a hybrid composite/steel barrel according to an example embodiment of the invention.

FIG. 16 is a graphical plot of temperature profiles comparing a standard 100% steel rifle barrel to an example embodiment of this new invention. The X-Axis 38 represents the measured temperature of the barrels in degrees (F.). The Y-Axis 39 is represented in minutes of time. The rifle caliber used in this test was a 6.5 Creedmoor round for both the bare steel barrel thermal plot 40 along with the composite/steel rifle barrel plot 42. Before the temperature plots were measured, both rifle barrels were fired using a 147-grain filled cartridge made by Hornady whereby 20 rounds were fired within a one-minute period. After the 20 rounds that were fired, the barrel was allowed to cool down to ambient temperature naturally and temperature readings were recorded every minute 39. The temperatures were recorded using a standard type J thermocouple which were fixtured on the outside surface of the barrels at the midpoint of the longitudinal axis (bore) 1. The thermal plot of 41 was taken by machining a hole in a perpendicular orientation to the longitudinal axis of the hybrid composite/steel. This too was taken at the midpoint of the barrel and the hole was drilled down to the point at which the steel barrel was exposed.

The peak temperature reached on the all-steel barrel 40 was 227° F. with the peak temperature at the core 41 reaching 195° F. and the peak temperature on the outer surface of the composite barrel tube 42 reaching 185° F.

Therefore, there was approximately a 40-degree F. differential 44 between the outer composite barrel surface 42 compared to the outer temperature of the all-steel barrel 40 from the peak temperatures. All three temperature plots tended to follow a similar path except for the absolute temperature at the peak. The temperature differential between the core temperature 41 and the outer composite barrel 42 surface temperature was only 10 degrees F. at its peak which is a clear indicator that the heat is being conducted down through the longitudinal axis verses migrating through the thickness of the composite barrel 13. The temperature differential between the all-steel barrel 40 and the core temperature 41 was measured to be approximately 30 degrees F. 43. This is also a clear indicator of how well the composite barrel structure 13 is acting as an insulator. It is worth noting that the peak temperature on the outer surface of the composite barrel structure 42 is well below the polymer resin glass transition (Tg) temperature of 225 F. This prevents the softening of the polymer resin to the point at which the barrel stiffness is adversely affected. If metallic particles were to be added to the resin as is the case in the background disclosed examples aforementioned, then the resin would most likely heat up to the same peak temperature of 227° F. 40 and the Tg of the resin would be exceeded which would cause significant softening of the barrel and thusly effect the weapon's accuracy in a negative manner.

FIG. 17 (FIGS. 17A, 17B, 17C and 17D, collectively) are illustrations of both bullet impact groupings 38 at 100 yards and the extrapolated bullet impact group size 45 at 1,000 yards standoff distance. Beginning with the top view of the grouping 41 of the bullet strikes at 100 yards with an all-steel barreled rifle chambered in .308 caliber. This test was designed to identify how much the bullet moves between a cold barrel 41 (FIG. 17A) and a hot barrel 44 (FIG. 17C). Starting with the first tests conducted with the 100% steel barrel rifle 38, 41, the overall group size after four shots was 1.90" in diameter measured from the center of the first hole to the hole that is furthest away from the center of the first bullet strike. The first bullet strike 39 was the cold bore shot and the other three bullet strikes are represented by 40. There was no consistent pattern to the four strikes, however the results for the composite/steel barrel 44 showed a much different response. The measured group size with this test was 1.27" in diameter 44 or about a 30% reduction in the difference between the all-steel barrel group size 41 and the hybrid composite/steel barrel 14 group size 44. In reviewing the pattern of the next three bullet strikes 43 when the composite/steel barrel 14 was hot, the three bullets were very tightly grouped. This indicates that once the hybrid composite/steel barrel 14 was warming after the first shot, that the barrel had very little movement compared to the sporadic movement of the all-steel barrel 41. These results are confirmed again contained in the chart of FIG. 18. Accuracy testing may be conducted according to standard testing protocols with the same test parameters for each tested barrel, including for example and without limitation: bench shooting using sand bag supports; 100 yard range; measurement of shot groups using digital calipers to measure the greatest outside diameter or dimension of shot holes of the shot hole groups; calculations factored using minute of angle measurements (1 MOA-1.047" at 100 yards); shots fired one minute between shots; same ammunition for both barrel tests; and human or mechanical firing actuation.

Figure 17B:
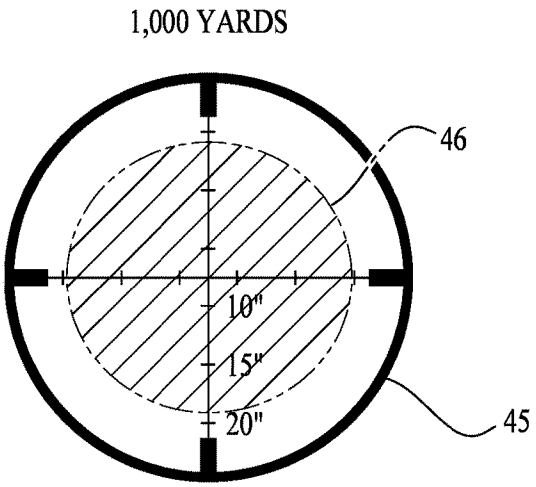
FIGS. 17A, 17B, 17C and 17D are illustrations of bullet migration due to a cold barrel and a hot barrel of an example embodiment of the invention in comparison to a steel barrel.
Figure 17D:
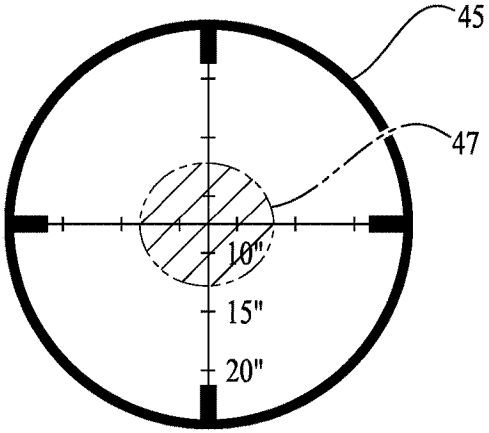
Figure 17A:
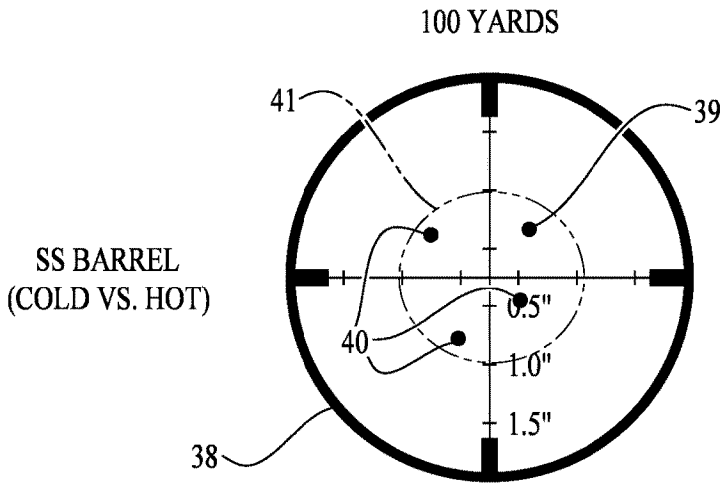
Figure 17C:
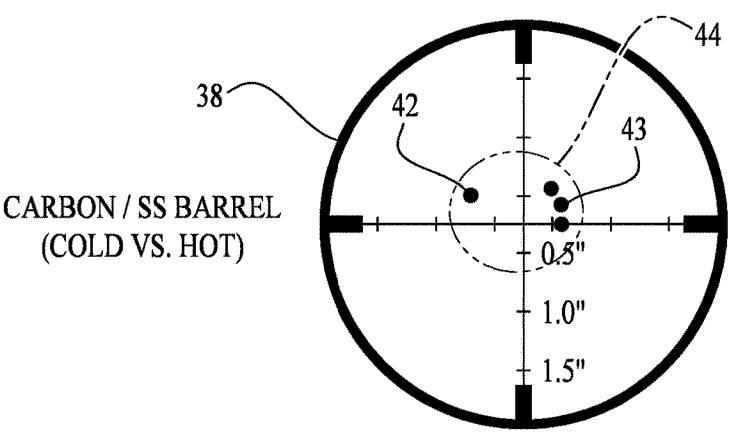

The two illustrations 45 located to the right of the grouping data test results 38, are extrapolations of the group sizes from 100 yards out to 1,000 yards. By taking the group sizes of the all-steel barrel 41 of 1.90 "and the composite/steel hybrid barrel 14 of 1.27" and multiplying these group sizes by a factor of ten, the group size for the steel barrel would increase to 19.0" in diameter 46 at 1,000 yards (FIG. 17B). This does not reflect other factors that could increase the size of the group at 1,000 yards such as: human error, windage, elevation, barometric pressure, among other factors. These factors would be the same for the composite/steel hybrid barrel 14, however based upon the group size of 1.27" at 100 yards 44 for this preferred embodiment, the estimated group size at 1,000 yards is 12.7" 47 (FIG. 17D) or just over 30% smaller. This new invention represents a substantial performance improvement in accuracy, especially for long range hunters and sharp shooters.

FIG. 18 is a collection charting accuracy test results comparing this new invention to an all-steel rifle barrel 47. For purposes of minimizing the large amount of test data, the data set was consolidated to simply show the rifle calibers 48, 51, and 52 along with the ammo type, torque settings on the tensioning end cap located at the extreme end of the muzzle and the grouping results 53. The first row in each sub-category of the different calibers contains the data set for the all-steel rifle barrel 50. In each category, an all-steel rifle barrel was fired and the grouping results were recorded at 100 yards 49. The standard testing protocol dictated that once the first round was fired, then the next three subsequent rounds would be included in the group size data. Once the all-steel barrel group 49 was captured, that same all-steel rifle barrel 11 was then machined down to accept the composite barrel tube 12. After the composite barrel tube 13 was adhesively bonded to form a complete hybrid composite/steel barrel assembly 14, the rifles were shot again and the grouping data was captured 53.

The first set of data 48 represents the results from a 6.5 Creedmoor caliber round. The group size for this all-steel barrel was 1.115". The results of the composite/steel barrel 14 had an average group size of 0.614" with very little variation between the three different torque level settings. This represents a 45% reduction in the group size. The torque settings refer to the amount of torsional force that is applied to the barrel (see description below regarding installation of tensioning nut 54). In general, and within typical application ranges, the higher the torque setting the stiffer the barrel becomes.

The second set of data 51 represents the results from a 0.308" caliber round. The group size for this all-steel barrel was 1.138". The results of the composite/steel barrel 14 had an average group size of 0.729" with very little variation between the three different torque level settings. This represents a 36% reduction in the group size.

The third set of data 52 represents the results from a .300 Winchester Magnum caliber round. The group size for this all-steel barrel was 0.633". The results of the composite/steel barrel 14 had an average group size of 0.501" with very little variation between the three different torque level settings. This represents a 21% reduction in the group size.

In all three of these test studies, the composite/steel hybrid barrels 14 outperformed the all-steel barrels while at the same time reduced the overall weight of the steel barrel by 50% or more. The average group sizes were reduced with this new invention anywhere from 21% to 45% depending on the caliber. The overall test results also clearly show a 30% improvement in reducing the movement of a bullet fired in a cold barrel versus a hot barrel. While various results and operational improvements that may be achieved by example embodiments of the invention are disclosed herein, the claimed invention is not intended to be limited by theory of operation or limited to particular results obtained.

Figure 19:
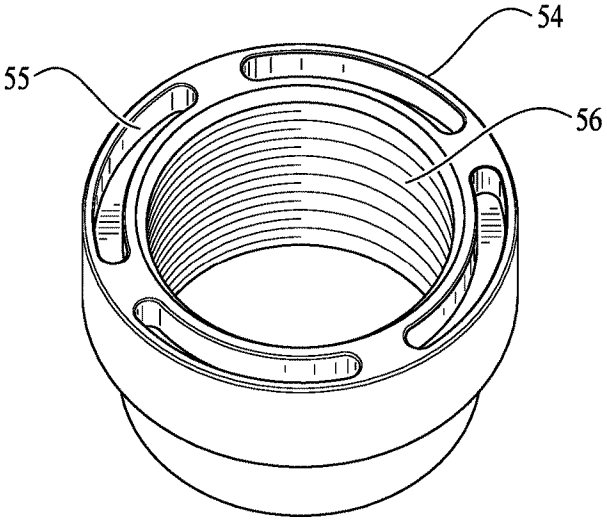
FIG. 19 is an isometric view of a tensioning nut component according to an example embodiment of the present invention.

FIG. 19 represents an isometric view of a tensioning nut according to an example embodiment. The tensioning nut 54 contains female threads 56 on the inside diameter which are an inverse of male threads located at the muzzle end of the steel barrel core 12. Male threads are located at the muzzle end of the machined steel barrel core 12 and can vary in pitch and depth depending on the caliber and the overall rifle barrel design. Although the practice of tensioning barrels has been known and practiced by gunsmiths for a long period of time, this new invention is novel in that at least the inner diameter, and optionally both the inner diameter and outer diameter of the composite outer sleeve portion of the hybrid barrel is/are tapered to generally match the external taper of the inner steel barrel core portion of the barrel. This allows the composite barrel portion to slide up over the outer tapered diameter of the steel barrel core liner and seat resulting in a self-aligning tapered fit between both the composite outer barrel portion or sleeve and the inner steel barrel core liner portion. This "Morse Taper" created between the steel barrel core 12 and the composite barrel tube 13 is held in compression by the use of the tensioning nut 54 which is torqued to a level that achieves the desired barrel straightness and stiffness. In example embodiments, the range of torsional loading ranges from five-foot pounds to thirty-foot pounds of torsional loading depending on the caliber of the rifle, but may be more or less in alternate embodiments. The torsional loading may be applied, for example, utilizing a tool 62 that is pressed into the receiving end of the tensioning nut 54 and then turned to tighten the nut to achieve the preferred torsional torque corresponding to a desired tension and compression loading. In the depicted embodiment, the tensioning nut 54 contains four symmetric female slots 55 in the end that accept four symmetric male corresponding posts 59 of the tool that fit tightly into the female slots 55. By utilizing a Morse Taper slip fit design which is held in place by the tensioning nut 54, the two components of the barrel self-align under compression resulting in improved accuracy compared to traditional non-tapered tensioned composite hybrid rifle barrels. The tensioning nut 54 places the steel barrel core 12 into tension and the composite slip fit barrel tube 13 into compression creating a truly tensioned hybrid rifle barrel 68. In some example embodiments, the tensioned barrel configuration may provide improved accuracy relative to a standard or non-tensioned barrel. As mentioned prior, the metal of the tensioning nut 54 in example embodiments is Stainless Steel, however in alternate embodiments other metals like, copper, aluminum, etc. could also be used. The taper angles can change based upon many factors like barrel length, barrel diameter, caliber loading, etc. In some example embodiments, the taper may range from about 0.003"/inch to 0.200"/inch. Taper rates may be specified as change in diameter per unit length in the case of a rod or tube. A Morse taper is the mating of an internally tapered part fitting over an externally tapered part where the taper rates are close to identical. Once these two parts are pressed together, it forms an airtight seal and extremely strong interface joint. In particular embodiments, the taper angle may be about 1 to 2 degrees, for example about 1.49 or 1.5 degrees, measured relative to the bore axis (i.e., about 2 to 4 degrees, for example about 3 degrees included angle between opposite sides).

Figure 20:
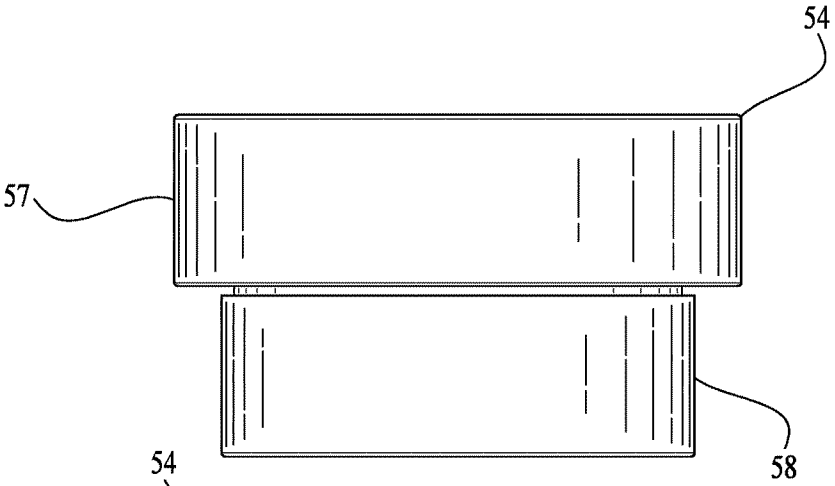
FIG. 20 is a side view of the tensioning nut according to an example embodiment of the present invention.

FIG. 20 is a side view of the tensioning nut 54 contained in an example embodiment. The major diameter 57 of the tensioning nut 54 has an outer diameter that is substantially the same outer diameter of the composite slip fit barrel tube 13, however in some cases the outer diameter of the tensioning nut 54 can be slightly smaller or larger than the outer diameter of the composite barrel tube 13 depending on what types of add on accessories are added to the muzzle end of the barrel. Specifically, items like muzzle brakes, flash suppressors, etc., may optionally be incorporated into the tensioning nut component. An important factor in the major diameter 57 of example embodiments of the tensioning nut 54, is that the shoulder section should substantially cover the end of the composite barrel tube 13 to maximize the load transfer of the tensioning nut 54 to the hybrid composite/steel barrel assembly 68. The smaller post diameter 58 is designed to narrowly fit into the undercut of the composite barrel tube 13 and provides for direct contact between the exposed metallic filaments contained within the wall thickness of the composite barrel tube 13. This direct contact with the continuous metallic filaments 17 allows for an optimum thermal path for conduction of heat created by the firing event. Furthermore, this post section 58 acts as a self-centering feature between the tensioning nut 54 and the composite slip fit barrel tube 13.

Figure 21:
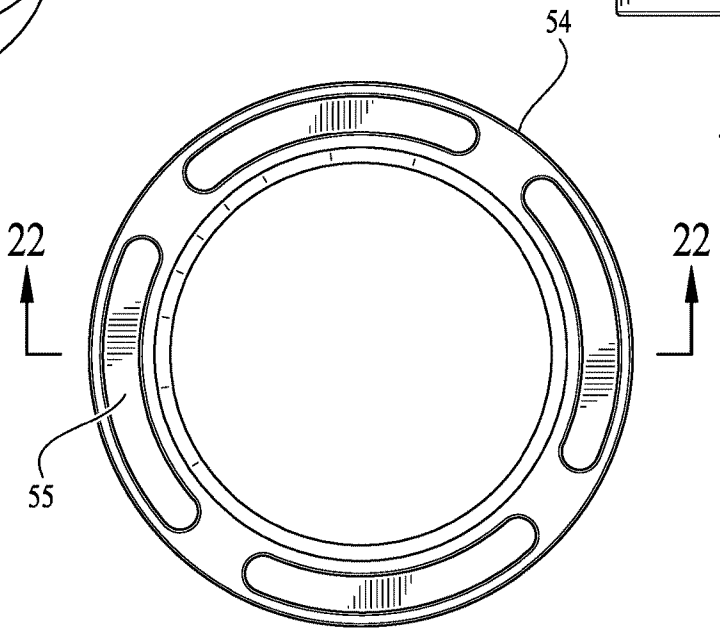
FIG. 21 is an end view of the tensioning nut according to an example embodiment of the present invention.

FIG. 21 is an end view of the tensioning nut 54 and shows the four slots 55 that are recessed into the tensioning nut 54. The shape of these slots 55 was discovered to be an optimum or advantageous design for the transfer of the torsional loads from the tool 62 into the tensioning nut 54 and had the highest overall strength and the lowest instance of slippage by the operator in example embodiments. In alternate embodiments, different configurations or types of engagement features may be utilized.

Figure 22:
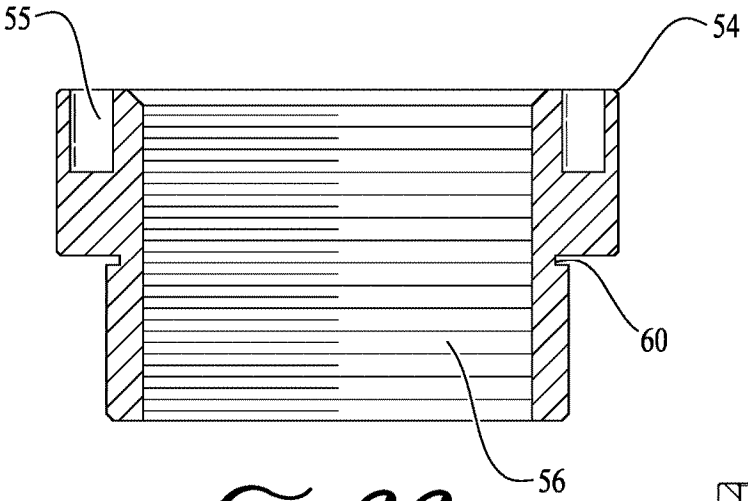
FIG. 22 is a cross-sectional side view of the tensioning nut according to an example embodiment of the present invention.

FIG. 22 is a cross-sectional side view of the tensioning nut 54 in an example embodiment. The female threads 56 extend throughout the longitudinal length of the tensioning nut 54 and are an inverse of the male threads located on the steel barrel core at the muzzle end of the barrel 12. The depth of the four slot channels 55 is preferably a minimum of 0.050" in depth and can vary depending on the tool 62 engagement depth and the amount of torsional loading applied to the composite barrel tube 13. There is an intentional undercut 60 that is machined into the tensioning nut 54 which provides for an adhesive path and reduces the probability of point loading the composite barrel tube 13 when the tensioning nut 54 is torqued down to the desired torsional loads.

Figure 23:
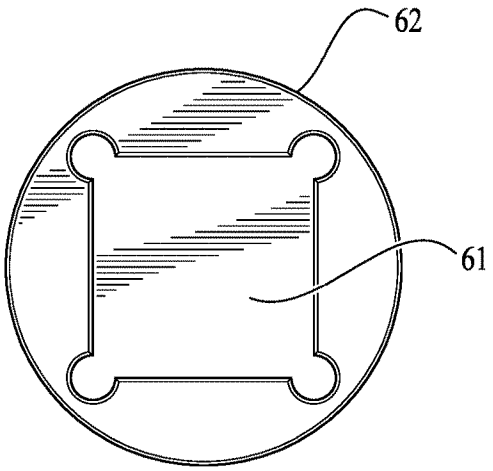
FIG. 23 is an end view of the rachet side of a tensioning nut tool according to an example embodiment of the present invention.

FIG. 23 is an end view of the tensioning nut tool 62 that is used to apply torsional loading onto the tensioning nut 54 and thusly the entire Hybrid Barrel Assembly 68. The center section 61 of the tensioning nut tool 54 is designed to accept a standard torque wrench and can vary in size from ¼", ⅜" or ½" shank size.

Figure 24:
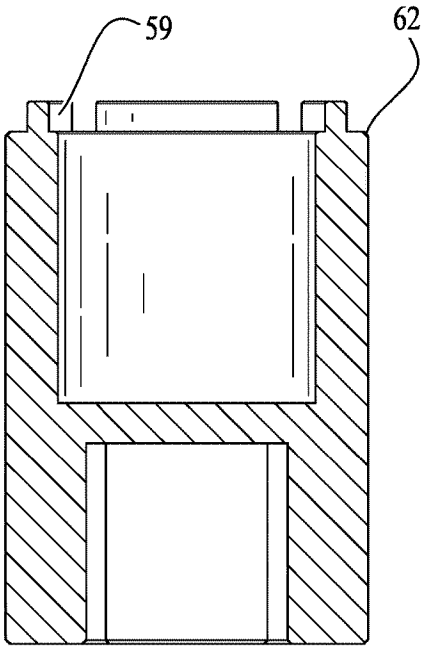
FIG. 24 is a cross-sectional view of the tensioning nut tool according to an example embodiment of the present invention.

FIG. 24 is a cross-sectional side view of the tensioning nut tool 62 that is used to apply torsional loading onto the tensioning nut 54. The male posts 59 slide into the receiving female slots 55 when the tool is inserted into the tensioning nut 54 itself. The preferred material for example embodiments of the tensioning nut is a hardened tool steel with a minimum hardness level of a Rockwell C60.

Figure 25:
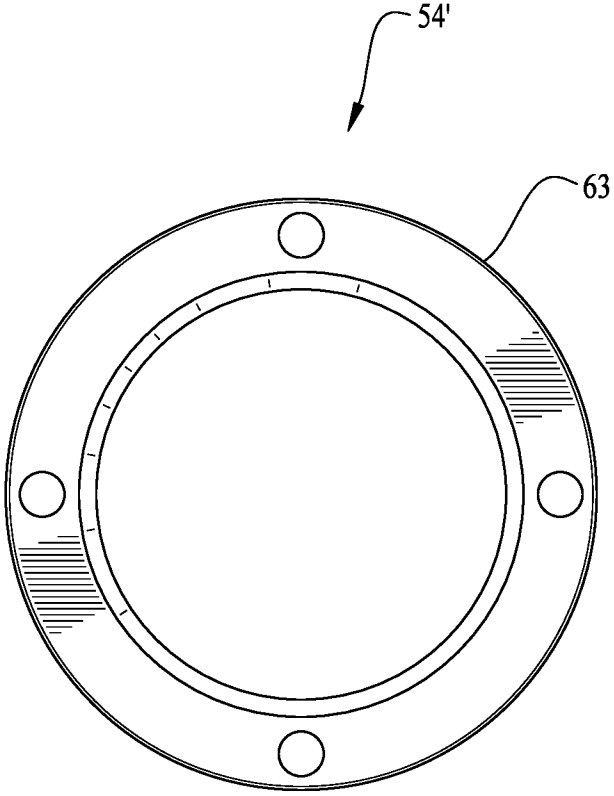
FIG. 25 is an end view of an alternate configuration for the tensioning nut including four equally distant spaced holes, according to another example embodiment of the present invention.

FIG. 25 is an end view of a tensioning nut 54' with an alternate four-hole configuration 63 compared to the previously described embodiment configuration 55. Although this design may not be as efficient as the previously described embodiment 55, it may be a lower cost option and is more than sufficient to handle the torsional loads of rim fired or rim-fire cartridges due to the lower pressures and lower barrel stiffness requirements.

Figure 26:
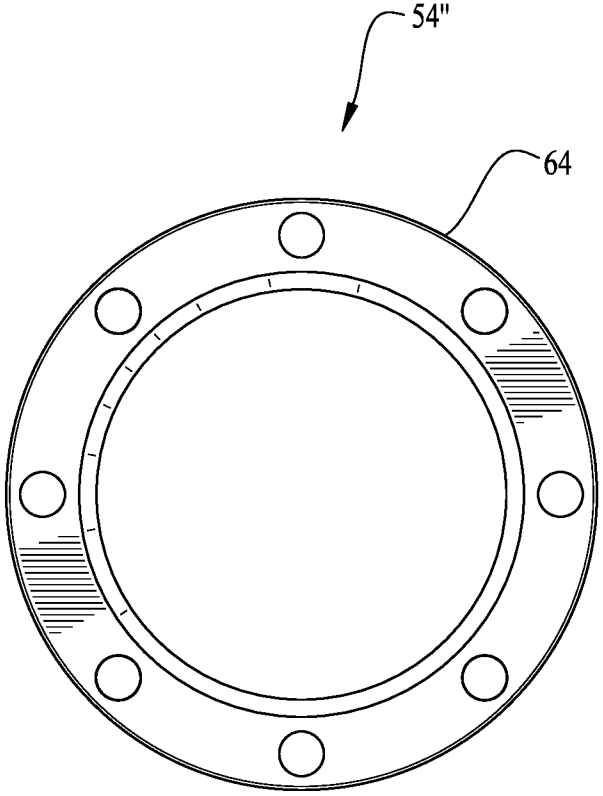
FIG. 26 is an end view of an alternate configuration for the tensioning nut including eight equal distant holes, according to another example embodiment of the present invention.

FIG. 26 is an end view of a tensioning nut 54" with an alternate eight-hole configuration 64 compared to the previously described embodiment configuration 55. Although this design may not be as efficient as the previously described embodiment 55, it has twice the strength of option 63 and may be a lower cost option compared to the previously described embodiment having the slot design 55. In further alternate embodiments, various different hole, slot, post, flat or other engagement configurations may be utilized. In further alternate embodiments, the tensioning nut may take alternate forms or configurations to achieve one or more additional functions in combination with its barrel tensioning function, for example in the form of a muzzle brake or compensator, a flash and/or sound suppressor, sight mount, choke tube or other features or components.

Figure 27:
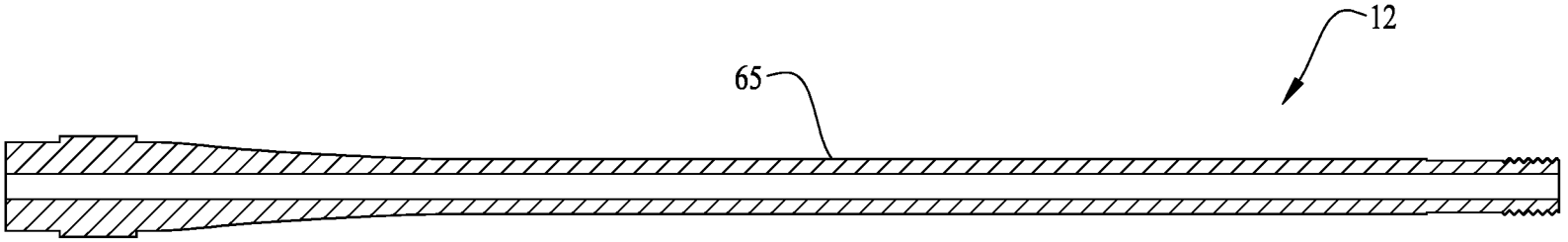
FIG. 27 is a cross-sectional view along the longitudinal axis of a steel core barrel liner after machining, according to an example embodiment of the present invention.

FIG. 27 is a cross-sectional view of the longitudinal axis of the machined down steel barrel core 12. The surface preparation prior to bonding the carbon slip fit barrel tube 13 is represented as 65 and are general methods and practices of preparing the surface of the steel barrel 12 for bonding. In example embodiments, the process 65 includes abrading (sanding) the outer surface of the steel barrel core 12 using a cleaning solvent like acetone and an abrasive pad. A wrap of masking tape may be placed on the exposed section of the chamber end so to ensure that the polished barrel section does not get scratched by the abrasive pad. In example embodiments of the process, the barrel is rotated as the operator hand abrades the steel barrel extending from the step-down chamber end extending to the threads at the muzzle end. The threads at the muzzle end are protected and not sanded during this process. Once the steel barrel core 12 has been sufficiently abraded, it may be completely wiped down from end to end using Acetone or equivalent solvent and lint free wipes. Once the steel barrel is completely cleaned it is ready for the adhesive application. In alternative forms, all or portions of the process may be automated or implemented by hand.

Figure 28:
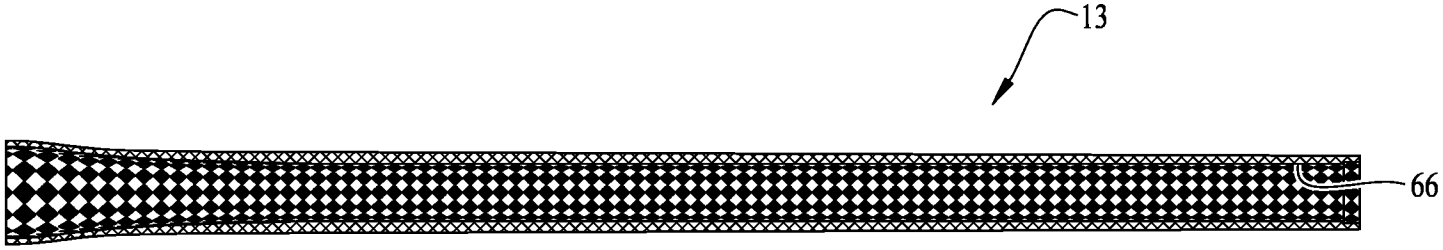
FIG. 28 is a cross-sectional view along the longitudinal axis of a carbon slip fit barrel tube, according to an example embodiment of the present invention.

FIG. 28 is a cross-sectional view of the longitudinal axis of the composite slip fit barrel tube or sleeve 13. The surface preparation prior to bonding the carbon slip fit barrel tube 13 is represented as 66 and are general methods and practices of preparing the internal surface of the composite barrel 13 for bonding. In example embodiments, the process 66 consists of abrading the inner surface of the composite barrel tube 13 using a cleaning solvent like acetone and a conical wire brush. The wire brush end may be attached to an electric drill or other device that rotates the wire brush as the brush is pushed down the inside of the composite barrel tube 13. The wire brush along with the cleaning solvent that is applied to the inside of the composite barrel tube 13, is repeatedly pushed down and back through the entire length of the composite barrel tube 13 until the surface is cleaned and free from any mold release transferred during the composite barrel tube 13 fabrication. Once the composite barrel tube 13 has been sufficiently abraded, it may be completely wiped down from end to end using Acetone or equivalent solvent and lint free wipes. Once the inside of the composite barrel tube 13 is completely cleaned and dried it is ready for the adhesive application. In alternative forms, all or portions of the process may be automated or implemented by hand.

Figure 29:
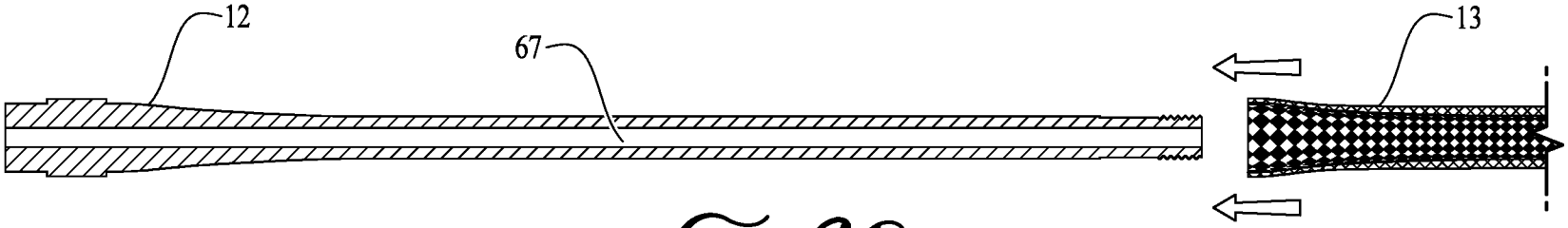
FIG. 29 is an assembly view detailing how the carbon slip fit barrel tube slides over the steel core barrel liner, according to an example method of the present invention.

FIG. 29 is an assembly view showing how the composite barrel tube 13, is bonded to the steel barrel core 12 by sliding the hollow composite tubular barrel or sleeve 13 over the steel barrel core after the adhesive is applied. This process 67 begins with both the steel barrel core 12 and the composite barrel tube 13 being properly abraded and cleaned prior to bonding. Once properly prepared, the adhesive is applied to the barrel. In the preferred embodiment, a two-part epoxy adhesive resin is used to bond the two parts together. The two-part adhesive yields excellent thermal conductivity while at the same time providing excellent shear strength and toughness necessary to handle the shock loads associated with the firing event. Other types of adhesives, including film adhesives, one part heat activated adhesives, induction curing adhesives, etc. can also be utilized apart from the preferred methodology of using a two-part epoxy adhesive. If necessary to aid in centering the composite barrel tube 13 to the steel barrel core 12, glass beads can be added to the epoxy to help in maintaining a uniform adhesive bondline thickness. Once the assembly is prepared for bonding, the adhesive is applied to the entire length of the bonding area located on the steel barrel core 12. After ensuring 100% coverage of the adhesive on the steel barrel core 12, the composite barrel tube 13 is pressed onto the steel barrel core 12, for example, by rotating the composite barrel tube 13 in a clockwise fashion around the steel barrel core 12 until the composite barrel tube 13 is flush with the shoulder located on the steel barrel core 12 at the chamber end of the barrel assembly 68. Once the composite barrel 13 is flush with shoulder of the steel barrel core 12, it is ready for the tensioning nut 54 to be installed prior to the adhesive setting and curing.

Figure 30:
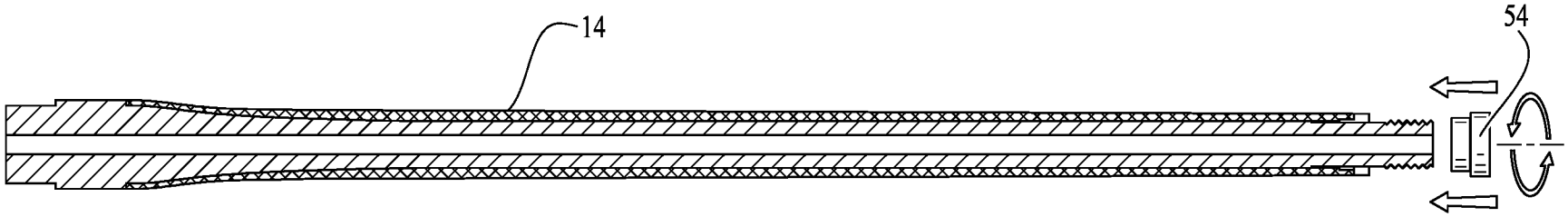
FIG. 30 is an assembly view detailing how the tension nut is applied, according to an example method of the present invention.

FIG. 30 is an assembly view of an example process of installation of the tensioning nut 54 onto the combined composite and steel barrel sections 14. This process involves threading on the tensioning nut 54 onto the threads of the steel barrel core 12 which extend beyond the length of the composite barrel tube 13. This process takes place shortly after the composite barrel tube 13 is pressed onto the steel barrel core 12 and is fully seated against the shoulder of the steel barrel core 12. The tensioning nut 54 is rotated onto the threads in a clockwise fashion and tightened by hand until the tension nut 54 seats squarely on the end of the composite barrel tube. Once hand tight, the operator then inserts the tensioning nut tool 62 into the end of the tensioning nut 54 and begin to tighten the tensioning nut 54 to the desired torque level setting. This process is performed while the epoxy adhesive is still in an uncured liquid phase and allows the barrel to cure under load. In alternative forms, all or portions of the process may be automated or implemented by hand.

Figure 31:
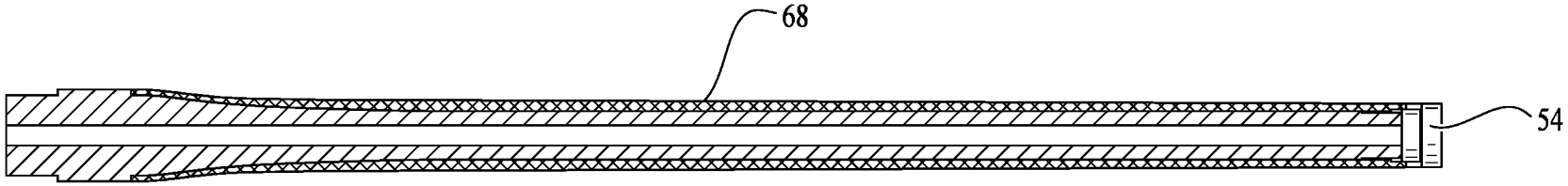
FIG. 31 is a cross-sectional view of the completed rifle barrel assembly with the tensioning nut, according to an example embodiment of the present invention.

FIG. 31 is a cross-sectional side view of the finished Hybrid composite/steel barrel 68 after the entire assembly has been bonded and cleaned. In example embodiments there are no threads extending from the end of the finished Hybrid Barrel 68 that are visible. The complete barrel assembly can be placed into an oven and cured for a period of 30 minutes at a temperature of about 185 degrees F. which will accelerate the curing of the epoxy resin so that the entire barrel assembly can be assembled into the stock once the barrel has cooled to room temperature.

Figure 32:
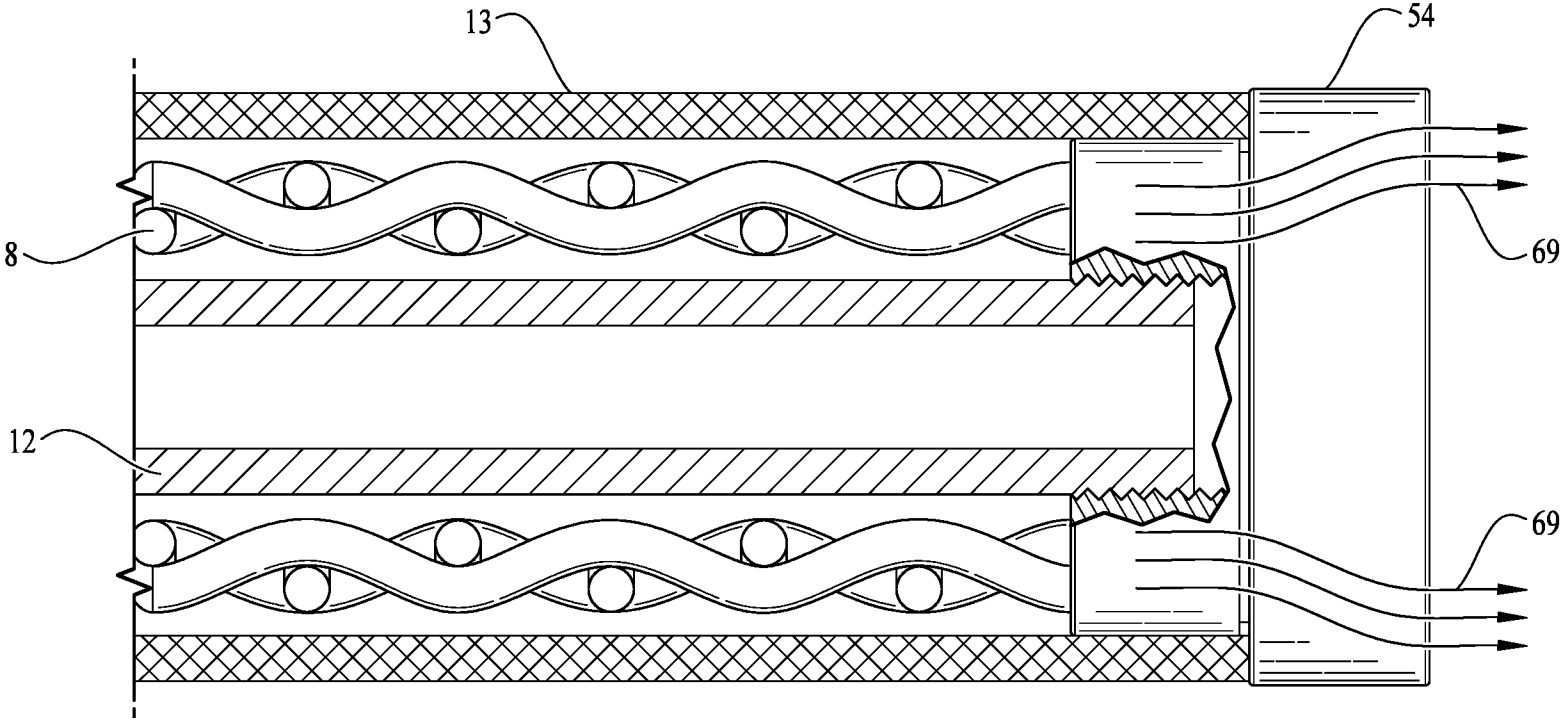
FIG. 32 is an exploded cross-sectional side view of the tension nut end of a rifle barrel assembly according to an example embodiment of the present invention.

FIG. 32 is a cross-sectional view of a closeup of the tensioning nut 54 and the composite barrel tube 13 interface. Once the tensioning nut 54 is torqued to the desired level and the epoxy adhesive is fully cured, the Hybrid Barrel 68 along with the tensioning nut 54 are locked into position and are permanent. This drawing shows that the stainless-steel continuous filaments 8 run through the entire length of the composite barrel tube 13 and make direct, thermally conductive contact with the flat surface of the tensioning nut 54 providing a superior conduction pathway for heat transfer and dissipation 69. In example embodiments, the metal mesh weave of the reinforcing layer 9 transfers and distributes heat generated by firing ammunition substantially uniformly along the length of the barrel 14 and throughout the overall body material of the barrel. The even heat distribution thus provided may assist in maintaining rigidity and straightness of the barrel, and thereby provide improved accuracy. Thermally conductive contact between the metal mesh weave of the reinforcing layer 9 and the tensioning nut 54 allows further heat transfer from the mesh weave to the metal body of the tensioning nut, whereby the tensioning nut serves as a heat sink to remove heat from the barrel and/or as a radiator to discharge heat to the ambient surroundings.

In various aspects and example embodiments, the invention includes the following features and advantages, individually and/or in any combination(s) thereof:

Example 1: A hybrid composite/steel bolt action rifle comprising: a steel rifled barrel liner that has been machined down from its original geometry to a reduced weight in order to accept a composite tubular barrel which is installed over the lightweight steel barrel liner and adhesively bonded to form a complete rigid hybrid rifle barrel; wherein said composite tubular barrel extends from the breech end of the barrel extending to the muzzle end of the barrel comprising a novel continuous metallic woven material that conducts heat created by the explosion of a rifle cartridge from the steel portion of the hybrid rifle barrel and directs the heat towards the muzzle end of the barrel; and wherein said composite tubular barrel channels the heat from the breech end to the muzzle end and thusly reduces the amount of heat that is conducted into the non-metallic reinforced section located outside of the metallic weave section, and reduces the heat of the overall barrel which improves the accuracy of the rifle and keeps the hybrid barrel from overheating.

Example 2: The composite rifle barrel tube of Example 1 wherein, the sheet of metal mesh comprises at least one of stainless steel, steel, aluminum, brass, titanium, nickel, silver, and nitinol.

Example 3: The composite rifle barrel tube of Example 1 wherein, the metallic filaments extend in a continuous fashion from the breech end to the muzzle end.

Example 4: The composite rifle barrel tube of Example 1 wherein, the number of layers of metal weave are dependent on the amount of heat generated due to the explosion of the propellant contained with the cartridge of the round.

Example 5: The composite rifle barrel tube of Example 1 wherein, the sheet of metal mesh comprises wire having a diameter less than 0.010 inches.

Example 6: The composite rifle barrel tube of Example 1 wherein, the sheet of metal mesh comprises wire having a diameter from 0.001 inches to 0.010 inches.

Example 7: The composite rifle barrel tube of Example 1, wherein the sheet of metal mesh is woven.

Example 8: The composite rifle barrel tube of Example 1, wherein the sheet of metal mesh is knitted.

Example 9: The composite rifle barrel tube of Example 1, wherein the sheet of metal mesh is an alloy.

Example 10: The composite rifle barrel tube of Example 1, wherein the polymeric resin is a standard curing epoxy resin at 300° F. which contains no metallic filler to achieve substantial thermal transfer of heat from the breech end of the rifle barrel extending to the muzzle end.

Example 11: A method of manufacturing a composite rifle barrel tube, comprising:

wrapping a plurality of non-isotropic composite layers around a mandrel; and wrapping one or more reinforcing layers around at least one of the pluralities of non-isotropic layers;

wherein the reinforcing layer(s) comprise a combination of woven metal mesh spanning the circumferential and longitudinal axis of the composite rifle barrel; and wherein the metal mesh has at least a weft wire count of a minimum of 80 (and in particular embodiments a minimum of 10) metal filaments per square inch and a warp wire count of a minimum of 80 (and in particular embodiments a minimum of 50) metal filaments per square inch.

Example 12: The method of Example 11, wherein the metal mesh layers in conjunction with the additional composite layers are attached to the steel tool(mandrel) so that the center of each of the composite plies are rolled on the centerline axis of the bore, thusly eliminating off axis plies and reducing the barrel twist associated with off axis plies due to a filament winding process.

Example 13: The method of Example 11, wherein the woven metal mesh is annealed.

Example 14: The method of Example 11, wherein the woven metal mesh is impregnated with a polymeric resin that is not filled with metallic particles to increase the resins thermal conductivity.

Example 15: The method of Example 11, wherein the woven metal mesh has a plain weave, Dutch weave, Heddle weave, or a 5-harness satin weave.

Example 16: The method of Example 11, wherein there is a plurality of non-isotropic layers comprised of at least one of carbon fiber uni-directional prepreg tape and one of metal mesh woven prepreg. The uni-directional carbon fiber prepreg can consist of both Pan based carbon fiber and Pitch Based Carbon fiber with an elastic modulus range from 33 Msi up to 120 Msi.

Example 17: The method of Example 11, wherein the metal mesh is oriented in the composite rifle barrel tube at a zero- and ninety-degree wire orientation, where the zero-degree metal wires are in line with the longitudinal axis of the composite barrel tube, and the ninety-degree wires are oriented transverse to the longitudinal axis.

Example 18: The method of Example 11, wherein the plurality of composite layers are staggered during the rolling process where every plies starting point on the steel mandrel is rolled in a clockwise fashion with start points in increments of 90 degrees circumferentially.

Example 19: The method of Example 11, wherein the finished hollow composite barrel tube is adhesively bonded to the steel rifle barrel liner using a thermally conductive epoxy resin that does not exceed a bondline thickness of 0.005" inches.

Example 20: The method of Example 11, wherein the finished bonded complete hybrid rifle barrel is bonded in place utilizing a tensioning end cap nut that is threaded onto the threads protruding beyond the end of the composite barrel tube end. The tensioning nut is then set to a predetermined torque setting.

Example 21: The method of Example 11, wherein the outer layers of the composite barrel tube consist of a carbon fiber weave that is oriented at a +/−45-degree fiber angle relative to the longitudinal axis of the composite barrel tube which reduces the barrel twist (torsional deflection).

Example 22: The method of Example 17, wherein the combination of the stiffness critical longitudinal carbon fiber plies are rolled in a longitudinal direction with no off-axis fibers, along with the metal mesh weave limiting the transfer of heat into these stiffness critical plies that have a large impact on the rifle barrel accuracy, the resulting hybrid composite/steel rifle barrel significantly reduces the bullet migration movement between a cold barrel and a hot barrel.

Example 23: The method of Example 17, wherein the metal mesh plies are separated with carbon fiber plies that are oriented in the direction transverse to the longitudinal axis thusly providing a thermally insulative layer around each layer of the metal mesh weave which increases the thermal transfer rate of the metal mesh ply from the breech end of the rifle barrel to the muzzle end of the rifle barrel.

Example 24: The method of Example 17, wherein the carbon fiber layer that is interleafed between the metal mesh weave is approximately the same ply thickness of the metal mesh weave.

Example 25: A barrel for a firearm, the barrel comprising:

an inner steel barrel liner; and an outer composite tubular barrel sheath installed over the inner steel barrel liner and adhesively bonded thereto.

Example 26: The barrel of Example 25, wherein the firearm comprises a firearm format selected from a rifle, a handgun, and a shotgun.

Example 27: The barrel of Example 26, wherein the firearm comprises an action selected from a bolt action, a semi-automatic action, an automatic action, a pump action, a lever action, a break action, and a falling block action.

Example 28: The barrel of Example 25, wherein the outer composite tubular barrel sheath comprises at least one sheet of metal mesh material, and at least one layer of carbon fiber weave material.

Example 29: The barrel of Example 28, wherein the metal mesh material comprises a plurality of metallic strands or filaments oriented at a +/−45-degree fiber angle relative to a longitudinal axis of the barrel.

Example 30: The barrel of Example 28, wherein, the sheet of metal mesh comprises at least one of stainless steel, steel, aluminum, brass, titanium, nickel, silver, nitinol, and combinations or alloys thereof.

Example 31: The barrel of Example 28, wherein the metallic filaments extend in substantially continuously from a breech end of the barrel to a muzzle end of the barrel.

Example 32: The barrel of Example 28, wherein the sheet of metal mesh material is woven.

Example 33: The barrel of Example 28, wherein the sheet of metal mesh material is knitted.

Example 34: The barrel of Example 28, wherein the sheet of metal mesh material is impregnated with a polymeric resin that does not contain metallic particles.

Example 35: The barrel of Example 28, wherein the outer composite tubular barrel sheath is adhesively bonded to the inner steel rifle barrel liner using a thermally conductive epoxy resin.

Example 36: The composite rifle barrel tube of Example 1 wherein, the inner diameter and the outer diameters of the composite rifle barrel tube consist of both parallel and tapered sections.

Example 37: The steel barrel core of Example 1 wherein, the outer diameter consists of both parallel and tapered sections.

Example 38: Wherein the internal diameters and taper rate profile of the composite barrel tube and the outer diameters and taper rate profile of the steel barrel core of Example 37 are identical except for the thickness of the adhesive bondline.

Example 39: Wherein the mating of the tapered steel barrel core and the composite barrel tube of Example 38, creates a "Morse Taper" lock between the two parts thus improving the alignment and straightness between the two parts thusly increasing the barrel accuracy.

Example 40: The Hybrid Barrel assembly of Example 1 wherein, a tensioning nut is threaded onto the end of the steel barrel core threaded end and tightened down onto the composite Barrel tube placing the steel barrel core in tension and the composite barrel tube in compression resulting in a tunable barrel stiffness.

Example 41: The tensioning nut of Example 40 wherein, the metal of the tensioning nut comprises at least one of: stainless steel, aluminum, copper, nickel and silver.

Example 42: The tensioning nut of Example 40 wherein, the design of the nut seats into an undercut machined into the composite barrel tube located at the muzzle end of the tube which exposes the ends of the continuous stainless-steel filaments. These ends make direct perpendicular contact with the flat face of the tension nut providing a highly efficient thermal transfer connection.

Example 43: The tensioning nut of Example 40 wherein, the design of the nut seats into an undercut machined into the composite barrel tube located at the muzzle end of the tube which provides for a centering device between the steel barrel core and the composite barrel tube.

Example 44: The tensioning nut of Example 40 wherein, the tool attachment connection points between the tension nut itself and the tension nut tool have a matching male/female interface which provides for excellent torsional transfer from the tool to the tension nut.

Example 45: The tensioning nut of Example 40 wherein, the preferred embodiment consists of four symmetric slots instead of holes to effectively transfer the torsional loads with minimal slippage.

Example 46: A method of assembly for attaching the composite barrel tube to the steel barrel core utilizing a two-part epoxy resin in conjunction with the tensioning nut.

Example 47: The method of Example 46 wherein, the adhesive used to bond the outer composite barrel tube and the steel inner barrel core can consist of a variety of adhesives including: film adhesives, one part heat activated adhesives, cyano-acrylate adhesives, etc.

Example 48: The method of Example 46 wherein the torsional loads applied by tightening or loosening the tensioning nut during the curing period of the adhesive can change the barrel straightness and can be tuned to yield highly straight barrels that don't change in straightness once the adhesive is fully cured.

While the invention has been described with reference to example embodiments, it will be understood by those skilled in the art that a variety of modifications, additions and deletions are within the scope of the invention, as defined by the following claims.

What is claimed is:

1. A firearm comprising a hybrid composite/steel barrel, the barrel further comprising:

a metal inner barrel liner; and a composite outer barrel sleeve, the composite outer barrel sleeve comprising carbon fibers;

wherein the metal inner barrel liner has an external taper from a larger breech end dimension to a smaller muzzle end dimension, and wherein the composite outer barrel sleeve has an internal taper configured to generally match the external taper of the inner barrel liner and fit in close engagement therewith when assembled, and wherein the composite outer barrel sleeve is adhesively bonded to the metal inner barrel liner; and wherein the metal inner barrel liner comprises a first thread profile at a muzzle end thereof, and wherein the barrel further comprises a tensioning nut having a second thread profile configured for cooperative engagement with the first thread profile, to engage the composite outer barrel sleeve onto the inner barrel liner.

2. The firearm of claim 1, wherein the composite outer barrel sleeve is adhesively bonded to the metal inner barrel liner using a thermally conductive epoxy resin.

3. The firearm of claim 1, wherein the tensioning nut is tightened during assembly of the barrel to place the inner barrel liner in tension and the composite outer barrel sleeve in compression.

4. The firearm of claim 1, wherein the composite outer barrel sleeve further comprises metallic fibers.

5. The firearm of claim 4, wherein the barrel defines a length extending in a lengthwise direction from the breech end to the muzzle end, and wherein at least some of the metallic fibers extend along substantially the entire length of the barrel to conduct and dissipate heat in the lengthwise direction.

6. A firearm comprising a hybrid composite/steel barrel, the barrel further comprising:

a metal inner barrel liner; and a composite outer barrel sleeve, the composite outer barrel sleeve comprising carbon fibers;

wherein the metal inner barrel liner has an external taper from a larger breech end dimension to a smaller muzzle end dimension, and wherein the composite outer barrel sleeve has an internal taper configured to generally match the external taper of the inner barrel liner and fit in close engagement therewith when assembled, and wherein the composite outer barrel sleeve is adhesively bonded to the metal inner barrel liner; and wherein the composite outer barrel sleeve comprises at least one layer of carbon fiber material comprising the carbon fibers; and at least one layer of woven metal mesh material comprising metallic fibers.

7. The firearm of claim 6, wherein the woven metal mesh material has a weft wire count of at least 80 metallic fibers per square inch and a warp wire count of at least 80 metallic fibers per square inch.

8. The firearm of claim 6, wherein the metal mesh material is oriented in the barrel at a zero-degree and ninety-degree fiber orientation, wherein zero-degree fibers of the metal mesh material are generally aligned with a longitudinal bore axis of the barrel and ninety-degree fibers of the metal mesh material are aligned generally transverse to the longitudinal bore axis of the barrel.

9. The firearm of claim 1, wherein the metal inner barrel liner comprises a rifled internal bore.

10. The firearm of claim 1, wherein the metal inner barrel liner comprises steel.

11. The firearm of claim 6, wherein the metallic fibers comprise at least one of stainless steel, steel, aluminum, brass, titanium, nickel, silver, and/or nitinol.

12. The firearm of claim 6, wherein the carbon fibers at least partially comprise polyacrylonitrile-based carbon fibers.

13. The firearm of claim 6, wherein the carbon fibers at least partially comprise a carbon fiber uni-directional prepreg tape.

14. The firearm of claim 6, wherein the carbon fibers at least partially comprise a carbon fiber weave mesh material.

15. The firearm of claim 6, wherein the composite outer barrel sleeve further comprises a polymeric resin encapsulating at least a portion of the carbon fibers.

16. The firearm of claim 15, wherein the polymeric resin does not contain metallic particles.

17. The firearm of claim 1, wherein the composite outer barrel sleeve comprises a plurality of layers staggered with fibers of each layer's starting point offset in increments of about 90 degrees circumferentially from an adjacent layer.

18. The firearm of claim 1, further comprising a stock portion, the firearm being configured as a rifle, a shotgun, or a handgun.

19. A firearm barrel comprising:

a metal inner barrel liner; and a composite outer barrel sleeve, the composite outer barrel sleeve comprising carbon fibers;

wherein the metal inner barrel liner has an external taper from a larger breech end dimension to a smaller muzzle end dimension, and wherein the composite outer barrel sleeve has an internal taper configured to generally match the external taper of the inner barrel liner and fit in close engagement therewith when assembled, and wherein the composite outer barrel sleeve is adhesively bonded to the metal inner barrel liner; and wherein the metal inner barrel liner comprises a first thread profile at a muzzle end thereof, and wherein the firearm barrel further comprises a tensioning nut having a second thread profile configured for cooperative engagement with the first thread profile, to engage the composite outer barrel sleeve onto the inner barrel liner.

20. The firearm barrel of claim 19, wherein the composite outer barrel sleeve is adhesively bonded to the metal inner barrel liner using a thermally conductive epoxy resin.

21. The firearm barrel of claim 19, wherein the tensioning nut is tightened during assembly of the firearm barrel to place the inner barrel liner in tension and the composite outer barrel sleeve in compression.

22. A method of fabricating a firearm barrel, the method comprising:

providing a metal inner barrel liner having an external taper from a larger breech end dimension to a smaller muzzle end dimension;

providing a composite outer barrel sleeve having an internal taper configured to generally match the external taper of the inner barrel liner; and assembling the composite outer barrel sleeve over the metal inner barrel liner with the internal taper of the composite outer barrel sleeve fitting in close engagement with the external taper of the metal inner barrel liner wherein the metal inner barrel liner comprises a first thread profile at a muzzle end thereof, the method further comprising:

providing a tensioning nut having a second thread profile configured for cooperative engagement with the first thread profile; and tightening the second thread profile of the tensioning nut onto the first thread profile of the metal inner barrel liner to place the inner barrel liner in tension and the composite outer barrel sleeve in compression.

23. The method of claim 22, further comprising adhesively bonding the internal taper of the composite outer barrel sleeve to the external taper of the metal inner barrel liner using a thermally conductive epoxy resin.

* * * * *